US010107081B2

(12) United States Patent
Paulsen

(10) Patent No.: US 10,107,081 B2
(45) Date of Patent: Oct. 23, 2018

(54) METHOD FOR RECOVERY OF HYDROCARBON FLUID

(71) Applicant: IMPACT TECHNOLOGY SYSTEMS AS, Lysaker (NO)

(72) Inventor: Jim-Viktor Paulsen, Drammen (NO)

(73) Assignee: IMPACT TECHNOLOGY SYSTEMS AS, Lysaker (NO)

( * ) Notice: Subject to any disclaimer, the term of this patent is extended or adjusted under 35 U.S.C. 154(b) by 544 days.

(21) Appl. No.: 14/366,629

(22) PCT Filed: Dec. 19, 2012

(86) PCT No.: PCT/EP2012/076148
§ 371 (c)(1),
(2) Date: Jun. 18, 2014

(87) PCT Pub. No.: WO2013/092712
PCT Pub. Date: Jun. 27, 2013

(65) Prior Publication Data

US 2014/0338895 A1 Nov. 20, 2014

(30) Foreign Application Priority Data

Dec. 19, 2011 (DK) ..... 2011 70725
Dec. 21, 2011 (EP) ..... 11194897

(51) Int. Cl.
*E21B 47/06* (2012.01)
*E21B 43/16* (2006.01)
(Continued)

(52) U.S. Cl.
CPC ..... *E21B 43/16* (2013.01); *E21B 28/00* (2013.01); *E21B 43/003* (2013.01); *E21B 47/00* (2013.01); *E21B 49/008* (2013.01)

(58) Field of Classification Search
CPC ..... E21B 28/00
See application file for complete search history.

(56) References Cited

U.S. PATENT DOCUMENTS 1,730,336 A 10/1929 Bellocq
2,887,956 A 5/1959 Kunkel
(Continued)

FOREIGN PATENT DOCUMENTS

CN 1768202 A 5/2006
CN 1921987 A 2/2007
(Continued)

OTHER PUBLICATIONS

Singh A. K.: "Generation of pressure pulses by impacting an opposed-anvil setup with a low-velocity projectile", Rev. Scl. Instrum,vol. 60 (2), Feb. 1989, pp. 253-257.
(Continued)

*Primary Examiner* — William D Hutton, Jr.
*Assistant Examiner* — Avi T Skaist
(74) *Attorney, Agent, or Firm* — Muncy, Geissler, Olds & Lowe, P.C.

(57) ABSTRACT

A method is described for recovery of a hydrocarbon fluid from a porous medium by injection of a fluid into the porous medium. The method includes determining a Rayleigh time on the basis of the density of the fluid and the hydrocarbon fluid, the median pore diameter of the porous medium, and surface tension between the fluid and the hydrocarbon fluid. The method includes arranging a chamber in fluid communication with the porous medium via at least one conduit, and having the chamber comprising first and second wall parts movable relative to each other. The pressure stimulation includes providing an impact pressure in the fluid to propagate to the porous medium via the conduit, wherein the impact pressure is generated by the collision process between an object arranged outside of the fluid and the first wall parts for the first wall part to impact on the fluid in the chamber.

18 Claims, 18 Drawing Sheets

(51) Int. Cl.

| | |
|---|---|
| ***E21B 28/00*** | (2006.01) |
| ***E21B 43/00*** | (2006.01) |
| ***E21B 47/00*** | (2012.01) |
| ***E21B 49/00*** | (2006.01) |

(56) References Cited

U.S. PATENT DOCUMENTS

| | | | | |
|---|---|---|---|---|
| 3,048,226 | A | 8/1962 | Smith | |
| 3,189,121 | A | 6/1965 | Vander Stoep | |
| 3,367,443 | A | 2/1968 | Mayne | |
| 3,586,461 | A | 6/1971 | Erlandson | |
| 3,974,652 | A | 8/1976 | Lovmark | |
| 4,049,053 | A | 9/1977 | Fisher et al. | |
| 4,147,228 | A * | 4/1979 | Bouyoucos | G01V 1/147 181/114 |
| 4,286,929 | A | 9/1981 | Heath et al. | |
| 4,341,505 | A | 7/1982 | Bentley | |
| 4,429,540 | A | 2/1984 | Burnham | |
| 4,621,656 | A | 11/1986 | Ichimaru | |
| 4,622,473 | A | 11/1986 | Curry | |
| 4,863,220 | A | 9/1989 | Kolle | |
| 4,901,290 | A | 2/1990 | Feld et al. | |
| 4,917,575 | A | 4/1990 | Miller, Jr. et al. | |
| 5,000,516 | A | 3/1991 | Kolle et al. | |
| 5,152,674 | A | 10/1992 | Marx | |
| 5,249,929 | A | 10/1993 | Miller, Jr. et al. | |
| 5,282,508 | A | 2/1994 | Ellingsen et al. | |
| 5,425,265 | A * | 6/1995 | Jaisinghani | G01N 15/088 73/38 |
| 5,628,365 | A | 5/1997 | Belonenko | |
| 5,950,726 | A | 9/1999 | Roberts | |
| 5,950,736 | A | 9/1999 | Goldstein | |
| 6,015,010 | A | 1/2000 | Kostrov | |
| 6,020,653 | A | 2/2000 | Woodbridge et al. | |
| 6,237,701 | B1 | 5/2001 | Kollé et al. | |
| 6,241,019 | B1 | 6/2001 | Davidson et al. | |
| 6,729,042 | B2 | 5/2004 | Lee | |
| 6,910,542 | B1 | 6/2005 | Walter | |
| 6,976,507 | B1 | 12/2005 | Webb et al. | |
| 7,245,041 | B1 | 7/2007 | Olson | |
| 7,304,399 | B2 | 12/2007 | Leijon et al. | |
| 7,318,471 | B2 | 1/2008 | Rodney et al. | |
| 7,405,489 | B2 | 7/2008 | Leijon et al. | |
| 7,464,772 | B2 | 12/2008 | Hall et al. | |
| 7,816,797 | B2 | 10/2010 | Nair | |
| 2001/0017206 | A1 | 8/2001 | Davidson et al. | |
| 2002/0050359 | A1 | 5/2002 | Eddison | |
| 2003/0201101 | A1 | 10/2003 | Kostrov et al. | |
| 2004/0071566 | A1 | 4/2004 | Hill, Jr. | |
| 2004/0256097 | A1 | 12/2004 | Byrd et al. | |
| 2005/0084333 | A1 | 4/2005 | Zadig | |
| 2005/0169776 | A1 | 8/2005 | McNichol | |
| 2005/0189108 | A1* | 9/2005 | Davidson | B01J 8/16 166/249 |
| 2005/0224229 | A1 | 10/2005 | Blacklaw | |
| 2005/0236190 | A1 | 10/2005 | Walter | |
| 2006/0293857 | A1 | 12/2006 | Moos et al. | |
| 2007/0187090 | A1 | 8/2007 | Nguyen et al. | |
| 2007/0187112 | A1 | 8/2007 | Eddison et al. | |
| 2007/0251686 | A1 | 11/2007 | Sivrikoz et al. | |
| 2009/0107723 | A1 | 4/2009 | Kusko et al. | |
| 2009/0159282 | A1 | 6/2009 | Webb et al. | |
| 2009/0178801 | A1 | 7/2009 | Nguyen et al. | |
| 2009/0200018 | A1 | 8/2009 | Sivrikoz et al. | |
| 2009/0272555 | A1 | 11/2009 | Wisakanto et al. | |
| 2009/0301721 | A1 | 12/2009 | Barykin | |
| 2009/0308599 | A1 | 12/2009 | Dusterhoft et al. | |
| 2011/0011576 | A1 | 1/2011 | Cavender et al. | |
| 2011/0108271 | A1 | 5/2011 | Hinkel et al. | |
| 2012/0175107 | A1 | 7/2012 | Kostrov et al. | |
| 2013/0233059 | A1* | 9/2013 | McDonnell | G01N 11/00 73/54.04 |

FOREIGN PATENT DOCUMENTS

| | | | |
|---|---|---|---|
| CN | 101413494 | A | 4/2009 |
| CN | 101432502 | A | 5/2009 |
| DE | 75164 | | 8/1893 |
| DE | 102005005763 | | 8/2006 |
| EP | 2 063 123 | A2 | 5/2009 |
| EP | 2063126 | A2 | 5/2009 |
| GB | 2027129 | A | 2/1980 |
| JP | 2001082398 | | 3/2001 |
| NO | 20092071 | | 11/2010 |
| RU | 16527 | U1 | 1/2001 |
| RU | 2171354 | | 7/2001 |
| SU | 1710709 | A1 | 2/1992 |
| WO | WO87/06653 | | 11/1987 |
| WO | WO 2004/085842 | A1 | 10/2004 |
| WO | WO2004/113672 | A1 | 12/2004 |
| WO | WO2005/079224 | A2 | 9/2005 |
| WO | WO2005/093264 | A1 | 10/2005 |
| WO | WO2006/129050 | A1 | 12/2006 |
| WO | WO2007/076866 | A1 | 7/2007 |
| WO | WO2007/100352 | A1 | 9/2007 |
| WO | WO2007/113477 | A1 | 10/2007 |
| WO | WO 2007/127766 | A1 | 11/2007 |
| WO | WO2007/139450 | A2 | 12/2007 |
| WO | WO2008/054256 | A1 | 5/2008 |
| WO | WO2009/063162 | A2 | 5/2009 |
| WO | WO2009/082453 | A2 | 7/2009 |
| WO | WO2009/089622 | A1 | 7/2009 |
| WO | WO/2009/111383 | A2 | 9/2009 |
| WO | WO2009/132433 | A1 | 11/2009 |
| WO | WO2009/150402 | A2 | 12/2009 |
| WO | WO2010/137991 | A | 12/2010 |
| WO | WO2011/157740 | A1 | 12/2011 |

OTHER PUBLICATIONS

F. Herrmann and M. Seitz: "How does the ball-chain work?", Am. J. Phys. vol. 50 (11), Nov. 1982, pp. 977-981.

Pride, et al.: "Seismic stimulation for enhanced oil recovery", Geophysics, vol. 73, Sep. 17, 2008, pp. 023-035.

F. Herrmann and P. Schmalzle: "Simple explanation of a well-known collision experiment", Am. J. Phys., vol. 49 (8); Aug. 1981, pp. 761-764.

Maurice Dusseault, et al., "Pressure Pulsing: The Ups and Downs of Starting a New Technology", JCPT, Apr. 2000, vol. 39, No. 4, pp. 13-19.

* cited by examiner

| Experiments<br>A=Standard method<br>*B =Pressure Transients* | Core Pore Volume (ml) | Dimension L/D (cm) | Kw (mDarcy) | Original oil in Place (ml) | Flooding speed (μm/s) | Oil Produced (ml) | Oil Recovery (% of OOIP) |
|---|---|---|---|---|---|---|---|
| 1 A | 37.0 | 14.8/3.79 | 540 | 30.0 | 1.48 | 16.1 | 53.6 |
| ***1 B*** | ***37.3*** | ***14.8/3.79*** | ***540*** | ***29.9*** | ***1.48*** | ***19.4*** | ***64.9*** |
| 2 A | 19.7 | 10.0/3.705 | 134 | 15.8 | 1.55 | 8.3 | 52.5 |
| ***2 B*** | ***19.7*** | ***10.0/3.705*** | ***134*** | ***16.1*** | ***1.55*** | ***9.3*** | ***57.8*** |
| 3 A | 37.0 | 14.8/3.79 | 540 | 30.0 | 14.8 | 16.2 | 54.0 |
| ***3 B*** | ***37.0*** | ***14.8/3.79*** | ***540*** | ***30.6*** | ***30-40*** | ***20.7*** | ***67.6*** |
| 4 A | 19.7 | 10.0/3.705 | 134 | 15.8 | 15.5 | 8.4 | 53.2 |
| ***4 B*** | ***19.7*** | ***10.0/3.705*** | ***134*** | ***16.1*** | ***15.5*** | ***9.9*** | ***61.5*** |

Fig. 7

METHOD FOR RECOVERY OF HYDROCARBON FLUID

FIELD OF THE INVENTION

The present invention relates to a method for recovery of a hydrocarbon fluid from a porous medium.

BACKGROUND OF THE INVENTION

Hydrocarbon recovery operations may in general involve a broad range of processes involving the use and control of fluid flow operations for the recovery of hydrocarbon from subterranean formations, including for instance the inserting or injection of fluids into subterranean formations such as treatment fluids, consolidation fluids, or hydraulic fracturing fluids, water flooding operations, drilling operations, cleaning operations of flow lines and well bores, and cementing operations in well bores.

Subterranean reservoir formations are porous media comprising a network of pore volumes connected with pore throats of difference diameters and lengths. The dynamics of fluid injection into the reservoirs to displacing the fluids in the porous ground structure in a reservoir has been studied extensively in order to obtain improved hydrocarbon recovery.

The porous ground structure is the solid matrix of the porous media. Elastic waves can propagate in the solid matrix, but not in the fluid since elasticity is a property of solids and not of fluids. The elasticity of solids and the viscosity of fluids are properties that define the difference between solids and fluids. The stresses in elastic solids are proportional to the deformation, whereas the stresses in viscous fluids are proportional to the rate of change of deformation.

The fluids in the reservoir will (during water flooding) experience capillary resistance or push when flowing through pore throats due to the surface tension between the fluids and the wetting condition of walls of the pore throats. The capillary resistance causes a creation of preferred fluid pathways in the porous media (breakthrough), which limits the hydrocarbon recovery considerably. Thus, capillary resistance limits the mobility of the fluids in the reservoir.

The hydrocarbon recovery has been seen to increase after seismic events such as earthquakes. The dramatic dynamic excitation of the formation caused hereby is believed to increase the mobility of the fluid phase in the porous media. It has been claimed that the improved mobility during an earthquakes is caused by elastic waves (in the solid matrix) propagating across the reservoir. Seismic stimulation methods based on inducing elastic waves in the reservoir by applying artificial seismic sources have been investigated. In general artificial seismic sources need to be placed as close as possible to the reservoir to be effective and are thus commonly placed at or near the bottom of the wellbore. Such downhole seismic stimulation tools have been described in e.g. RU 2 171 345, SU 1 710 709, or WO 2008/054256 disclosing different systems where elastic waves in solids are generated by collisions by loads falling anvils secured to the bottom of the well, and thereby on the reservoir formation. Disadvantages of these systems are the risk of fragmentation of the ground structure as well as difficulties in controlling the impact and limited effectiveness of the methods.

Methods for hydrocarbon recovery involving dynamic excitations mimicking seismic events by e.g. use of explosives and regular detonations of energetic materials in the ground have also been developed and extensively used. However, such violent excitations by explosives, earthquakes and the like are often also seen to cause deterioration of the ground structure that may decrease the hydrocarbon recovery over longer time.

Other methods for hydrocarbon recovery involve pressure pulsing by alternate periods of forced withdrawal and/or injection of fluid into the formation. The application of pressure pulses has by some been reported to enhance the flow rates through porous media, but has however also been reported to increase the risk of water breakthrough and viscous fingering in fluid injection operations.

Time dependent pressure phenomenon such as pressure surge or hydraulic shock have primarily been reported on and analysed in relation to their potentially damaging or even catastrophic effects when unintentionally occurring e.g. in pipe systems or in relation to dams or off-shore constructions due to the sea-water slamming or wave breaking on platforms. Water Hammering may often occur when the fluid in motion is forced to stop or suddenly change direction for instance caused by a sudden closure of a valve in a pipe system. In pipe systems Water Hammering may result in problems from noise and vibration to breakage and pipe collapse. Pipe systems are most often equipped with accumulators, bypasses, and shock absorbers or similar in order to avoid Water Hammering.

Another kind of pressure phenomenon (referred herein as impact pressure) is produced by collision processes employing impact dynamics, which makes it possible to generate a time dependent impact pressure with large amplitude and very short time width (duration) comparable to the collision contact time.

In comparison to a pressure wave, pressure pulses can be seen to propagate like a relatively sharp front throughout the fluid. When impact pressure is compared with pressure pulses, one notice that impact pressure has an even sharper front and travels like a shock front. An impact pressure therefore exhibits some of the same important characteristic as pressure pulses, but they possess considerably more of this vital effect of having a sharp front of high pressure amplitude and a short rise time due to the way it is generated. Further, pressure pulses and impact pressure as described in this document are to be distinguished from elastic waves, since these first mentioned pressure phenomena propagate in fluids in contrast to elastic waves propagating in solid materials.

OBJECT OF THE INVENTION

It is therefore an object of embodiments of the present invention to overcome or at least reduce some or all of the above-described disadvantages of the known methods for hydrocarbon recovery operations by providing procedures to increase the hydrocarbon recovery factor.

It is a further object of embodiments of the invention to provide a method for hydrocarbon recovery operations, which may yield an increased fluid mobility inside the porous media.

A further object of embodiments of the invention is to provide alternative methods of and systems for generating impact pressure for instance applicable within the field of hydrocarbon recovery operations and applicable to fluids in subterranean reservoir formations or wellbores.

It is yet a further object of embodiments of the invention to provide a method which may be relatively simple and inexpensive to implement on existing hydrocarbon recovery sites, and yet effective.

It is an object of embodiments of the invention to provide native systems for generating impact pressures in a fluid with increased efficiency, and reduced risk of cavitations within the system.

In accordance with the invention this is obtained by a method for recovery of a hydrocarbon fluid from a porous medium by injection of a fluid into the porous medium, comprising determining a median pore diameter of the porous medium, and determining a Rayleigh time on the basis of the density of the fluid and the hydrocarbon fluid, the median pore diameter of the porous medium, and surface tension between the fluid and the hydrocarbon fluid. The method further comprises providing a pressure stimulation in the fluid, wherein the pressure stimulation is generated by a collision process with a collision contact rise time which is of the range of 1-100 times the Rayleigh time, such as in the range of 10-80 times the Rayleigh time or in the range of 1-10 times the Rayleigh time, such as in the range of 1-3 times the Rayleigh time.

According to an embodiment the pressure stimulation is generated by a collision process with a pressure rise time which is of the range of 1-100 times the Rayleigh time, such as in the range of 1-3 times the Rayleigh time. The pressure rise time may in an embodiment be at least 1-10 times the Rayleigh time.

In another aspect of the invention this is obtained by a method for recovery of a hydrocarbon fluid from a porous medium by injection of a fluid into the porous medium, comprising determining a median pore diameter a of the porous medium, and providing a pressure stimulation in the fluid, wherein the pressure stimulation is generated by a collision process generating an impact pressure with a pressure amplitude I and a pressure rise time $\Delta t$, where the pressure amplitude is larger than the relation $\gamma c\Delta t/a^2$, where $\gamma$ is the surface tension between the fluid and the hydrocarbon fluid, and c is the speed of sound in the porous media. By the speed of sound in the porous medium is to be understood the speed of sound in the fluid present in the porous medium, i.e. in the injection fluid and/or the hydrocarbon fluid.

By the collision process, energy as well as momentum from the colliding objects in the collision process is converted into an impact pressure in the fluid. The impact pressure travels and propagates with the speed of sound through the fluid and the porous media.

The generation of the impact pressure induced by the collision process may be advantageous due to the hereby obtainable very steep or abrupt pressure fronts with high amplitude, extremely short rise time as compared to e.g. the pressure pulses obtainable with conventional pressure pulsing technology. Further, the impact pressure induced by the collision process may be seen to comprise increased high frequency content compared e.g. to the single frequency of a single sinusoidal pressure wave.

This may be advantageous in different hydrocarbon recovery operations such as e.g. in water flooding, inserting of a treatment fluid, or in consolidation processes, as the high frequency content may be seen to increase the mobility of the fluid inside the porous media where materials of different material properties and droplets of different sizes may otherwise limit or reduce the mobility of the fluids. This may further be advantageous in preventing or reducing the risk for any tendency for blockage and in maintaining a reservoir in a superior flowing condition. An increased mobility may likewise be advantageous both in relation to operations of injecting consolidation fluids and in the after-flushing in consolidation operations.

In comparison to other conventional methods of pressure pulsing, the method according to the present invention is advantageous in that the impact pressure may here be generated in a continuous fluid flow without affecting the flow rate significantly. Further, the impact pressure generated by the collision process may be induced by very simple yet efficient means and without any closing and opening of valves and the control equipment for doing so according to prior art.

In relation to flooding operations, laboratory-scale experiments have been performed indicating an increased hydrocarbon recovery factor of 5-15% by the application of impact pressure induced by collision process as compared to a constant static pressure driven flow. The increased recovery rate was obtained with an unchanged flow rate.

In general, a feature of pressure pulses that makes them suitable for applications in hydrocarbon recovery operations is that they propagate like a steep front throughout the fluid as mentioned above. As impact pressure have an even steeper front or an even shorter rise time, impact pressure therefore exhibit the same important characteristic as pressure pulses, but to a considerably higher degree.

In relation to hydrocarbon recovery from porous media, it is believed that the high pressure in combination with the very short rise time which may be obtained by the methods according to the invention (and in comparison to what is obtainable with other pressure stimulation methods) provides a sufficient pressure difference over the length of a pore throat which can overcome the capillary resistance. The pressure difference is maintained over a sufficiently long time of at least 1-10 times longer than the Rayleigh time such as in the range of 1-100 times the Rayleigh time. On the same time, a relatively short duration ensures that the time average of the impact pressure do not contribute significantly in the Darcy relation for a porous medium, thereby reducing the risk of early breakthrough and viscous fingering. A sufficiently large pressure amplitude which can overcome the capillary resistance may be obtained by the amplitude of the impact pressure being larger than the relation $\gamma c\Delta t/a^2$, where $\gamma$ is the surface tension between the fluid and the hydrocarbon fluid, and c is the speed of sound in the porous media, and $\Delta t$ is the rise time of the impact pressure. Notice that a small rise time $\Delta t$ imply that the amplitude needed to overcome the capillary resistance is reduced. However, the rise time should be at least 1-10 times the Rayleigh time.

In this context, the application of impact dynamics (a collision process) as suggested by the invention, provides a simple and efficient method for maintaining a sufficient pressure difference for a time period of at least 1-10 times the Rayleigh time. Also, the application of a collision process has proven advantageous in providing a relative short rise time of the same order as or 10-100 the Rayleigh time. The contact rise time during the collision process may as shown later be estimated e.g. by applying the impact theory of Hertz. A short contact rise time of the order as or 1-100 times the Rayleigh time has proven advantageous for obtaining an increased hydrocarbon recovery factor from a porous media. Typically, the rise time of the impact pressure (the time that the pressure increases from zero to the maximum amplitude) is comparable to the contact rise time of the collision process and is of the order 1 ms (0.001 second) or less. The short rise time makes impact pressure unique when applied in recovery of hydrocarbon fluids.

According to an embodiment of the invention the collision contact rise time is simply determined as a percentage of the collision contact time of the collision process, such as in the range of 10-40%. Hereby may be obtained a reasonable estimate for the contact rise time relative to the total contact time in the collision process by simple means.

The contact time and contact rise time may be estimated by applying the impact theory of Hertz as explained in detail later. Additionally or alternatively, the contact time and/or contact rise time may be measured by experimental measuring methods such as e.g. by means of time lapsed imaging and fast camera shootings.

In an embodiment the collision contact rise time is determined on the basis of the mass, density, modulus of elasticity and Poisson's ratio of the colliding objects in the collision process, their relative velocities, and the bulk modulus of the fluid, e.g. from the impact theory of Hertz.

The median pore diameter of the porous medium may be determined on basis of the pore distribution for the medium. The pore distribution may be determined from samples of the porous medium by e.g. visual microscopic inspection, image analysis, flow porometry, gas adsorption, or mercury porosimetry.

In short mercury porosimetry is based on the capillary law (the Washburn equation) governing the fluid penetration into small pores. More specifically, the Washburn equation relates the applied pressure to the pore diameter. As the pressure increases during an analysis, pore diameter is calculated, and the corresponding volume of mercury required to fill these pores is measured. These measurements taken over a range of pressures provide a pore diameter distribution, and thereby the median pore diameter can be obtained. There are 5-10 times more pore throats than pore volumes, so the median pore diameter determines the capillary resistance in the porous media.

By the provision of a pressure stimulation in the fluid and a collision process generating an impact pressure with a pressure amplitude I fulfilling the criteria of $I>\gamma c\Delta t/a^2$, (where $\Delta t$ is the pressure rise time, $\gamma$ is the surface tension between the fluid and the hydrocarbon fluid, and c is the speed of sound in the porous media) is a obtained a sufficiently large pressure amplitude of the impact pressure over a sufficiently period (the pressure rise time). This is seen to be advantageous in yielding a pressure difference overcoming the capillary resistance in the porous medium. This is believed to lead to increased capillary fingering in the porous medium and thereby significantly increased oil recovery rates as also supported by experiments.

In an embodiment the pressure stimulation comprises generating an impact pressure with pressure amplitude in the range of 1-5 times larger than $\gamma c\Delta t/a^2$, such as 1.5-3 times larger.

In an embodiment of the invention, the method further comprises determining a capillary pressure on the basis of the diameters of the pore throats that causes the main capillary resistance in the porous medium, and the surface tension between the fluid and the hydrocarbon fluid, and wherein the pressure stimulation comprises generating an impact pressure with a pressure amplitude and rise time that yields a pressure difference of the order 1-5 times the capillary pressure over a length equal to the pore throat diameter of the porous medium.

The diameters of the pore throats causing the primary capillary resistance in the porous medium may be estimated as the median pore diameter. Employing the median pore diameter would be a good estimate of the pore throat diameter that is contributing mostly to the capillary resistance of the porous medium. In this embodiment, this then corresponds to determining a capillary pressure on the basis of the median pore diameter of the porous medium and generating an impact pressure with a pressure amplitude and rise time corresponding to a pressure difference of the order 1-5 times the capillary pressure over a length equal to the median pore diameter of the porous medium.

Hereby is obtained an advantageous pressure stimulation for improved oil recovery, where it is obtained an impact pressure which provides a sufficient pressure difference over the length of a pore throat in the porous medium which can overcome the capillary resistance. Further, from the given contact rise time close to or in the range of 1-100 times of the Rayleigh time is obtained that the pressure difference can be maintained over a sufficiently long time. Moreover, the short duration of the impact pressure ensures that the time average of the impact pressure do not contribute significantly in the Darcy relation thereby reducing the risk of early breakthrough and viscous fingering. The amplitude of the impact pressure needed to overcome the capillary resistance is proportional to the pressure rise time, thus the rise time should be as short as possible but at least 1-10 times the Rayleigh time.

Employing the collision process is a simple yet efficient method for generating the pressure stimulations with the desired said short duration and said sufficient pressure difference.

In an embodiment of the invention, the collision process comprises a collision between a falling object and a piston, where the object has a mass in the range of 10-10000 kg, such as in the range of 100-1500 kg, such as in the range of 500-1200 kg, and the object is caused to fall onto the piston from a height in the range of 0.02-2.0 m, such as in the range of 0.05-1.0 m, such as in the range of 0.1-0.5 m.

An embodiment of the invention concerns a method for recovery of hydrocarbon fluids from a porous medium by injection of fluid into the porous medium, comprising estimating the density of the fluids in the porous media, estimating the pore throat diameter that is contributing mostly to the capillary resistance of the porous medium, and estimating the surface tension between the fluids in the porous media, where fluids in the porous media include both hydrocarbon fluids and other fluids. Further, a Rayleigh time is determined based on the estimated density, diameter and surface tension, and a pressure stimulation in the fluid is provided, wherein the pressure stimulation is generated by a collision process with a collision contact time that yields a rise time which is of the range of 1-10 times the Rayleigh time, such as in the range of 1-3 times the Rayleigh time.

In an embodiment the method further comprises estimating the pore throat diameter that is contributing mostly to the capillary resistance of the porous medium, and estimating the surface tension between the fluids in the porous media, where fluids in the porous media include both hydrocarbon fluids and other fluids, and determining a capillary pressure on the basis of the estimated diameter and surface tension. Further, providing a pressure stimulation in the fluid, wherein the pressure stimulation is generated by a collision process that yields an amplitude and rise time that provides a pressure difference over the length of the said pore throat, and where the amplitude and rise time is such that the said pressure difference is of the order 1-5 times the capillary pressure.

According to an embodiment of the invention, the method further comprises arranging an at least partly fluid-filled chamber in fluid communication with the porous medium via at least one conduit, wherein the chamber comprises a first and a second wall part movable relative to each other, arranging an object outside of the fluid, and providing an impact pressure in the fluid to propagate into the porous medium via the conduit, wherein the impact pressure is generated by the collision process comprising a collision between said object and the first wall part, the first wall part thereby impacting on the fluid inside the chamber. In comparison to other conventional methods of pressure pulsing, the method according to the present invention is advantageous in that the impact pressure may here be generated in a continuous fluid flow without affecting the flow rate significantly. Further, the impact pressure generated by the collision process may be induced by very simple yet efficient means and without any closing and opening of valves and the control equipment for doing so according to prior art.

By the proposed method may further be obtained that the impact pressure may be induced to the fluid with no or only a small increase in the flow rate of the fluid as the first wall part is not moved and pressed through the fluid as in conventional pressure pulsing. Rather, the impact from the moving object on the first wall part during the collision may be seen to only cause the wall part to be displaced minimally or insignificantly primarily corresponding to a compression of the fluid in the impact zone. The desired fluid flow rate e.g. in a hydrocarbon recovery operation, may therefore be controlled more precisely by means of e.g. pumping devices employed in the operation, and may as an example be held uniform or near uniform at a desired flow regardless of the induction of impact pressure. The method according to the above may hence be advantageous e.g. in fluid injection and flooding operations where a moderate fluid flow rate with minimal fluctuations in said flow rate may be desirable in order to reduce the risk of an early fluid breakthrough and viscous fingering in the formation.

An embodiment of the invention further specifies that the chamber comprises a zone wherein gas-inclusions naturally gather by influence of the gravitational forces, and the conduit is arranged in or adjacent to said zone and/or the chamber is arranged such that the first wall part impacting on the fluid is placed away from said zone.

In fluid system involving fluid transport, the fluid almost inevitably at some time comprise inclusions of a gas—for instance in the form of air trapped in the system from the outset. Also, air bubbles may be created in the fluid due to turbulent flow, or due to the collision process of the first wall part impacting on the fluid. Any such gas-inclusions naturally due to the gravitational forces rise and gather in one or more zones of the chamber, where the gas-inclusions can rise no more. This occurs most often in the uppermost part of the chamber. As the method comprises arranging the chamber such as to avoid a build-up of gas-inclusions where the first wall part impacts on the fluid is obtained that the impact is performed on the fluid and not or only minimally on the gas-inclusions. Hereby the displacement of the first wall part is reduced, as the compressibility of the fluid is considerably lower than of gas-inclusions.

Reducing or avoiding a built-up of gas-inclusions near the impacting region thereby leads to impact pressures of higher amplitude, shorter rise time, and shorter contact time, due to better transfer of energy from the impacting object to fluid.

Further, by reducing or avoiding a built-up of gas-inclusions near the impacting region leads to reduced risk of cavitations in the fluid, which often lead to wear and damage in the fluid system. This is obtained as the energy of the impact is primarily transferred into impact pressure in the fluid and not into the gas-inclusions.

As the object is arranged outside the fluid to collide with the first wall part, may be obtained that the majority if not all momentum of the object is converted into impact pressure in the fluid. Otherwise, in the case the collision process was conducted down in the fluid, some of the momentum of the object would be lost in displacing the fluid prior to the collision.

The moving object may collide or impact with the first wall part directly or indirectly through other collisions. The chamber and wall parts may comprise various shapes. The chamber may comprise a cylinder with a piston, with the object colliding with the piston or the cylinder. The chamber may comprise two cylinder parts inserted into each other. The first wall part e.g. in the shape of a piston, may comprise a head lying on top of or fully submerged in the fluid inside the chamber. Further, the first wall part may be placed in a bearing relative to the surrounding part of the chamber or may be held loosely in place. The chamber may be connected to one or more conduits arranged for fluid communication between the fluid in the chamber and the reservoir, where the fluid may be applied e.g. in the hydrocarbon recovery operations such as a subterranean formation or a wellbore. Additionally, the chamber may be arranged such that the fluid is transported through the chamber.

The collision process may simply be generated by causing one or more objects to fall onto the first wall part from a given height. The size of the induced impact pressure may then be determined by the mass of the falling object, the falling height and the cross sectional area of the body in contact with the fluid. Hereby the amplitude of the induced impact pressure and the time they are induced may be easily controlled. Likewise, the pressure amplitude may be easily adjusted, changed, or customized by adjusting e.g. the masses of the object in the collision process, the fall height, the relative velocity of colliding objects, or cross sectional area (e.g. a diameter) of the first wall part in contact with the fluid. These adjustment possibilities may prove especially advantageous in fluid injection and fluid flooding since the difference between normal reservoir pressure and fracture pressure may often be narrow.

Since the collision process may be performed without the need for any direct pneumatic power source, the proposed method may be performed by smaller and more compact equipment. Further, the power requirements of the proposed method are low compared to e.g. conventional pressure pulse technology since more energy may be converted into impact pressure in the fluid by the collision process or impact.

The proposed method of applying impact pressure may advantageously be operated on or near the site where needed without any special requirements for cooling, clean environment, stability or the like special conditions which may make the proposed method advantageous for application in the field under harsh conditions. E.g. in hydrocarbon recovery operations the method may advantageously be operated from a platform or a location closer to the surface. In contrast to seismic stimulation tools acting on the solid structure and where the impact between the falling load and the anvil needs to be performed on the solid to be stimulated i.e. directly on the bottom of the wellbore, the system for performing the method according to embodiments of the invention is not restricted to any specific location and need not necessarily be placed submerged into the bottom of a wellbore, or be placed down on the seabed. By placing the system and applying the proposed method closer to or e.g. on the ground or on a platform or the like, one may advantageously need less expensive equipment and obtain easier and less expensive maintenance, especially when considering offshore operations.

Further, as the impact pressures are believed to be able to travel long distances with minimal loss, the suggested method may likewise if desirable be performed a distance away from the reservoir where the impact pressure is to be applied.

Further, as the method according to the invention is not conducted inside or down the wellbore or close to the subterranean formation, the impact pressure may possibly be induced into multiple wellbores or fluid injection sites simultaneously.

Further, the proposed impact pressure generation method may advantageously be performed on already existing fluid systems with no or only minor adjustments needed by simple post-fitting of the impact pressure generating equipment.

In the embodiment of the method, where the gas-inclusions are transported out of the chamber by arranging the conduit in or adjacent to the zone where the gas-inclusions naturally gather, is obtained that the gas-inclusions will efficiently and fast be completely or partly removed from chamber by the fluid continuously or at intervals in relation to the collision process. Any gas-inclusions may continue to gather in the zone, but a build-up is prevented by the described arrangement of the conduit by simple yet effective means.

In the embodiment of the method, where the chamber is arranged such that the first wall part impacting on the fluid is placed away from the zone is obtained that the impact is performed primarily on the fluid and not or only insignificantly on any gas-inclusions present in the chamber. In this way is obtained a method insensitive to the presence of gas-inclusions or creation of gas-inclusions in the fluid, and the fluid system need not be carefully vented prior to initiating any impact pressure process.

According to an embodiment, the collision process comprises the object being caused to fall onto the first wall part by means of the gravity force. As mentioned previously, this may hereby be obtained a collision process causing impact pressures of considerably size by simple means. The induced pressure amplitudes may be determined and controlled as a function of the falling height of the object, the impact velocity of the object, its mass, the mass of the first wall part and its cross sectional area in contact with the fluid. Pressure amplitudes in the range of 50-600 Bar such as in the range of 100-300 Bar such as in the range of 150-200 Bar may advantageously be obtained. The aforementioned parameters influence the rise time of the impact pressure which may advantageously be in the range of 0.1-100 ms at the point of measure such as in the range of 0.5-10 ms such as about a few milliseconds like approximately 0.01-5.0 ms.

According to an embodiment, the object collides with the first wall part in the air.

In a further embodiment of the invention, the method according to any of the above further comprises generating a number of the collision processes at time intervals. This may act to increase the effect of the impact pressure induced in the fluid. The impact pressure may be induced at regular intervals or at uneven intervals. As an example, the impact pressure may be induced more often and with lower time intervals earlier in the hydrocarbon recovery operation and at longer intervals later. The time intervals between the impact pressures may e.g. be controlled and adjusted in dependence on measurements (such as pressure measurements) performed on the same time on the subterranean formation.

According to embodiments of the invention, the collision processes are generated at time intervals in the range of 2-20 sec such as in the range of 4-10 sec, such as of approximately 5 seconds. The optimal time intervals may depend on factors like the type of formation, the porosity of the formation, the risk of fracturing etc. The preferred time intervals may depend on factors like the applied pressure amplitudes and rise time.

In an embodiment, the method comprises the step of generating a first sequence of collision processes with a first setting of pressure amplitude, rise time, and time between the collisions, followed by a second sequence of collision processes with a different setting of pressure amplitude, rise time, and time interval between the collisions. For instance bursts of impact pressures may in this way be delivered in periods. This may be advantageous in increasing the effect of the impact pressures. As previously mentioned, the amplitude and time interval of the induced impact pressure may be relatively easily modified and controlled by e.g. adjusting the weight of the moving object or by adjusting its falling height.

In an embodiment of the invention the setting of pressure amplitude and rise time is changed by changing the mass of the moving object, and/or changing the velocity of the moving object relative to the first wall part prior to the collision. The parameters of the impacts pressures such as the pressure amplitudes or rise time may hereby in a simple yet efficient and controllable manner be changed according to need.

BRIEF DESCRIPTION OF THE DRAWINGS

In the following different embodiments of the invention will be described with reference to the drawings, wherein:

FIG. 7 is a summary of some of the results obtained in water flooding experiments with and without impact pressure.

DETAILED DISCLOSURE OF THE DRAWINGS AND EMBODIMENTS OF THE INVENTION

Impact pressures are like propagating pressure shocks in a fluid and are generated by a collision process, —either by a solid object in motion colliding with the fluid, or by a flowing fluid colliding with a solid. The latter describes the Water Hammer phenomenon where momentum of the flowing fluid is converted into impact pressures in the fluid.

The physics of a collision process between a solid and a fluid is in the following described in more detail, first by looking at collisions between solid objects analysed from an idealized billiard ball model.

Figure 1A:
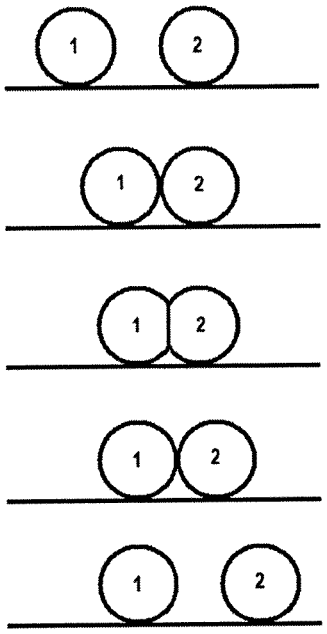
FIG. 1A-D illustrate principles of impact physics applicable for the understanding of impact pressure.

The billiard ball model is outlined in FIG. 1A illustrating different stages during a collision process between two billiard balls 1 and 2. The stages shown in this figure are from the top; 1) the stage of ball 1 moving with speed U towards ball 2 at rest, 2) the time of first contact, 3) the time of maximum compression (exaggerated), 4) the time of last contact, and 5) the stage of ball 2 moving with speed U and ball 1 at rest. The stages 2-4 are part of the impact stage (or just the impact). The impact starts at the time of first contact (stage 2) and ends at the time of last contact (stage 4), and the contact time is the duration from first to last contact.

The billiard ball model models the collision process as a perfect elastic process with no loss of kinetic energy during the cycle of compression (loading) and restitution (unloading). The billiard ball model assumes no penetration and no material parts exchanged between the balls during the collision process. The relative speed U of ball 1 is the impact speed, and after the time of first contact (stage 2) there would be interpenetration of the two balls were it not for the contact force arising in the area of contact between the two balls. The duration of the cycle of compression (from stage 2 to stage 3) is the contact rise time, and the duration of the cycle of restitution (from stage 3 to stage 4) is the contact decay time. Hence, the contact time (from stage 2 to stage 4) is the sum of the contact rise time and contact decay time.

The contact forces increases as the area of contact and compression increases. $\Delta t$ some instant during the impact the work done by the contact forces is sufficient to bring the speed of approach of the two balls to zero. This is the time of maximum compression (stage 3). The displacement (the amount of compression) of ball 1 during the cycle of compression can be estimated by employing the conservation of energy $MU^2=2F\Delta s$ and the conservation of momentum $F\Delta t=MU$, where $\Delta s$ is the displacement which is necessary for the work $F\Delta s$ to be equal to the kinetic energy. The contact time is $\Delta t$, and thus the displacement is given as $\Delta s=U\Delta t/2$.

An estimate of the contact time can be obtained by applying the theoretical principles in Hertz's theory of impact addressing the collision of a perfectly rigid sphere and a perfectly rigid planar surface. Hertz's law can be expressed as $$\Delta t = 2.86\left(\frac{M^2}{RE^{*2}U}\right)^{1/5}$$

when E* is written as $$\frac{1}{E^*} = \frac{1-\sigma_1^2}{E_1} + \frac{1-\sigma_2^2}{E_2},$$

E is the modulus of elasticity and a is the Poisson's ratio for the sphere (1) and planar surface (2). Landau and Lifschitz modified Hertz's law in order to obtain an equation $$\Delta t = 3.29\left(\frac{(1-\sigma^2)^2 M^2}{RE^2 U}\right)^{1/5}$$

for two identical balls with mass M and radius R, where now E is the modulus of elasticity and $\sigma$ is the Poisson's ratio of the two balls (see Landu and Lifschitz, Theory of elasticity, Theoretical Physics, Vol. 7, $3^{rd}$ edition, 1999, Butterworth-Heinemann, Oxford).

Billiard balls made of phenol-formaldehyde resin have a modulus of elasticity of about 5.84 GPa and a Poisson's ration of about 0.34. Two identical billiard balls with R=2.86 cm and =170 g colliding with impact speed U=1 m/s have a contact time of the order 0.13 ms, and thus $\Delta s$ would be of the order 0.065 mm. The contact force can be estimated by employing the equation $F=MU/\Delta t$ and the values above, thereby obtaining a contact force of the order 1.3 kN equal to the weight of an object with a mass of about 130 kg. This is a huge number compared with the mass of the two billiard balls (170 g). These observations form a fundamental hypothesis of rigid body impact theory. Despite a large contact force (1.3 kN), there is very little movement (0.065 mm) occurring during the very brief period of contact (0.13 ms).

Figure 1B:
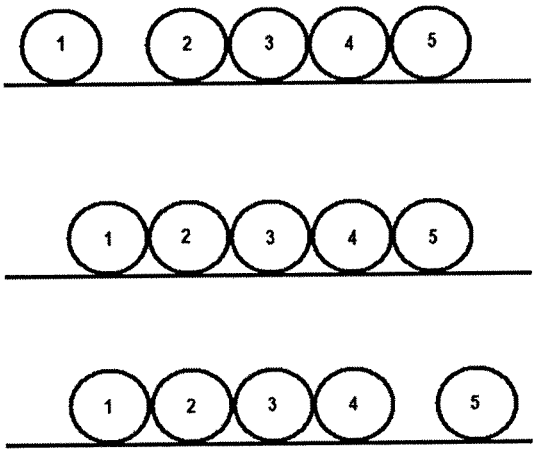

FIG. 1B outlines a collisions process involving a chain of five billiard balls, and the figure shows the following stages from the top; 1) the stage of ball 1 moving with speed U towards the balls 2-5 which are all at rest, 2) the stage of impact, and 3) the stage of ball 5 moving with speed U and the balls 1-4 at rest. The cycle of compression between ball 1 and 2 starts at the time of first contact between ball 1 and 2, and said cycle of compression ends at the time of maximum compression between ball 1 and 2. The cycle of restitution begins at the said time of maximum compression, but another cycle of compression between ball 2 and 3 starts at the same time as said cycle of restitution. Thus, the cycle of restitution between ball 1 and 2 evolves in parallel with the cycle of compression between ball 2 and 3.

This symmetry of restitution and compression propagates along the chain of billiard balls 1-5 until the cycle of restitution between ball 4 and 5. The last cycle of restitution ends with ball 5 moving with speed U, and thus the propagation of symmetric restitution and compression through the chain of balls transfer the momentum MU from ball 1 to ball 5. The symmetry of restitution and compression is broken at ball 5, and thus said propagation generates a motion of ball 5. Notice that the total contact time for the system illustrated in FIG. 1B is not $4\Delta t$, where $\Delta t$ is the contact time for the system described in relation to FIG. 1A, but rather equal to 3.5 $\Delta t$ as disclosed in e.g. Eur. J. Phys. 9, 323 (1988). This demonstrates that the cycle of compression and restitution overlap in time as explained above, and that the contact time for a chain of 3, 4 and 5 billiard balls are 1.5, 2.5 and 3.5 $\Delta t$ respectively.

Figure 1C:
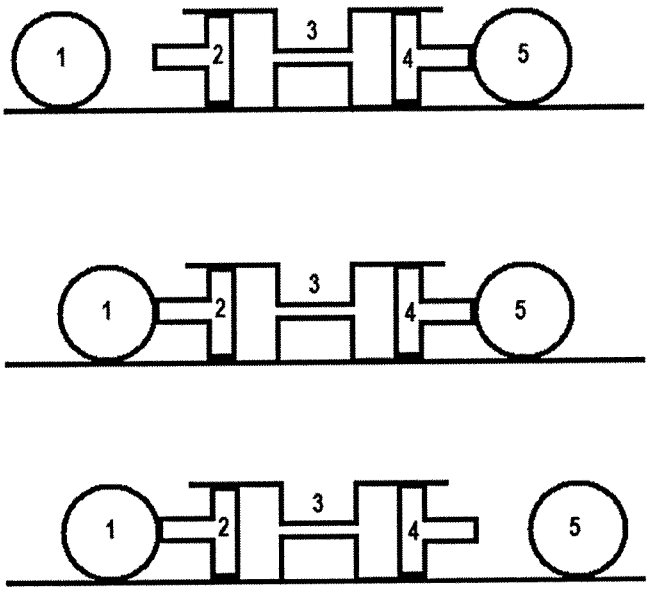

FIG. 1C outlines a collision process that is similar to the system described in relation to FIG. 1B only here involving collisions between solids and fluid media. The ball 1 here collides with piston 2 impacting on the fluid in turn impacting on piston 4 where at least some fraction of the momentum carried by the impact pressure is transferred into motion of ball 5. The pistons 2 and 4 can move inside the two fluid-filled cylinders, which are in fluid communication through the conduit 3. The cycle of compression between ball 1 and piston 2 starts at the time of first contact. A cycle of compression between piston 2 and the fluid inside of the first hydraulic cylinder also occurs during the impact, but it begins before the time of maximum compression between said ball 1 and said piston 2 due to the lower compressibility of a fluid compared with a solid.

The propagation of a symmetric cycle of restitution and compression through the chain of the billiard balls described in relation to FIG. 1B is likewise present here in the system illustrated in FIG. 1C with an additional symmetric cycle of restitution and compression in the fluid. The propagation in the fluid is transmitted as an impact pressure, which induces a cycle of compression followed by a cycle of restitution in the fluid as it travels through the fluid.

The time width or duration of the impact pressure measured at some point in the conduit 3 can be estimated by applying the Hertz's law $$\Delta t = 2.86\left(\frac{M^2}{RE^{*2}U}\right)^{1/5}$$

for the contact time. A relevant number for the time width of the impact pressure may be obtained by applying the expression for E*as given above, using a Poisson's ratio of 0.5 for the fluid and the bulk modulus of the fluid as the modulus of elasticity. Notice, however, that the time width should be of the order 3.5 Δt since the total collision process involves 5 objects (two billiard balls, two pistons and one fluid).

The total modulus of elasticity E* as written above becomes 0.37 GPa by employing data on water with a bulk modulus of 0.22 GPa. This demonstrates that the material with the lowest modulus of elasticity determines the value of the total modulus of elasticity E*. As an example, the billiard ball 1 with R=2.86 cm and M=170 g colliding with an impact speed U=1 m/s onto piston 2, yields a contact time of the order 0.37 ms. Therefore the time width of an impact pressure in conduit 3 may be estimated to be of the order 1.3 ms (0.37*3.5).

The event of ball 1 colliding with piston 2 and the sudden motion of ball 5 is separated in time, and said separation can be significant depending on the length of conduit 3. The impact physics in FIG. 1C is not described in all its details. The important points are, however, that impact pressures are generated by a collision process involving a moving solid object (ball 1), and that the impact pressure carries (or contain) momentum which can be converted into motion (and momentum) of a solid object (ball 5).

Figure 1D:
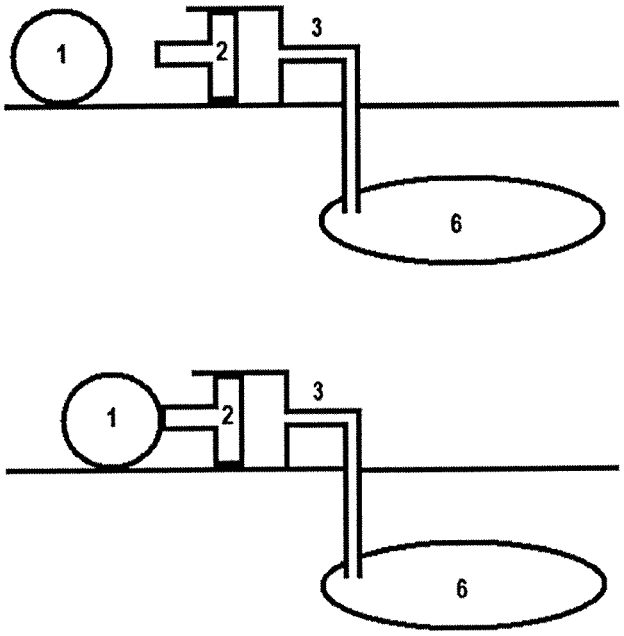

FIG. 1D outlines a collision process analogue to the system described in relation to FIG. 1C illustrating stages in the generation of impact pressure in a fluid. The ball 1 moves with speed U towards piston 2 in a hydraulic cylinder (above), and impacts the piston 2 movably seated inside a fluid-filled cylinder (below). The hydraulic cylinder is in fluid communication through the conduit 3 with a subterranean reservoir formation 6, so that the impact generates an impact pressure propagating into the subterranean reservoir formation. The impact pressure can induce motions in the subterranean reservoir formation, and may thus set fluids in motion in the subterranean reservoir formation that are normally immobile for instance due to various forces such as capillary forces.

Figure 2:
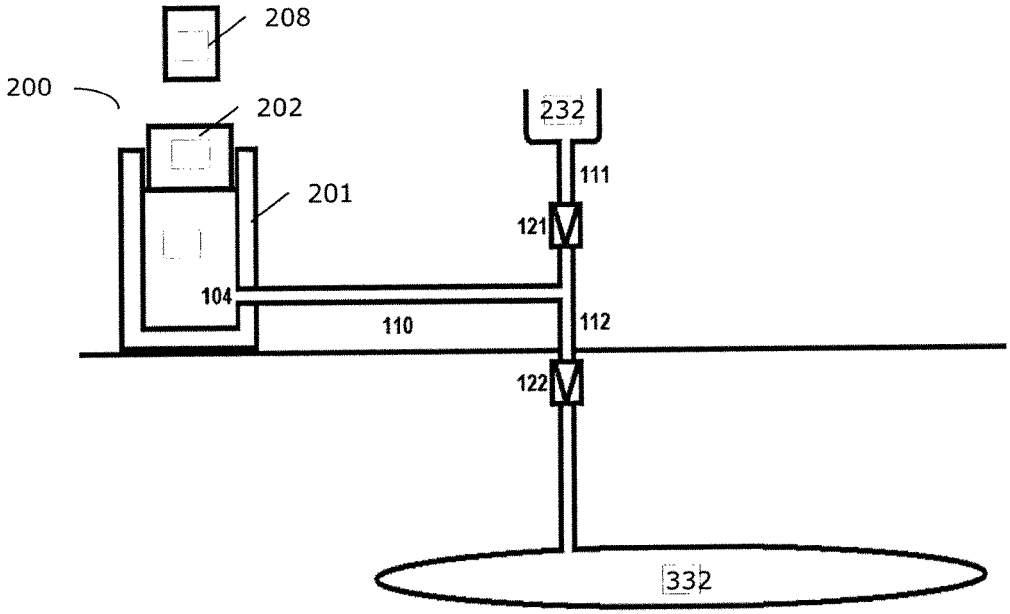
FIG. 2-3 show embodiments of apparatuses for generating impact pressures in a fluid in fluid communication with a subterranean reservoir.

FIG. 2 shows a possible embodiment of an apparatus 200 for generating impact pressures in a fluid which here is injected into a subterranean reservoir. The apparatus here comprises a piston 202 placed in a hydraulic cylinder 201 with an opening 104 and in fluid communication via conduit 110 to the reservoir 232 and a subterranean reservoir formation 332 for instance by connecting the conduit 110 to a well head of a well. The cylinder with the piston form two wall parts movable relative to each other in a fluid-filled chamber. The apparatus may alternatively or additionally be connected to any other type of reservoir not necessarily placed below ground. In this embodiment valves 121,122 are arranged in the conduits such that a fluid may only be displaced in the direction from the reservoir 232 towards the subterranean reservoir 332, where it may for instance be used to replace hydrocarbons and/or other fluids. In other embodiments no valves are placed in the conduits or in only some of the conduits. The one or more valves may be employed in order to reduce the ability of the impact pressure to propagate in any undesired direction such as toward the reservoir 232. The valve could be a check valve which closes when there is a pressure difference between the inlet and outlet of the check valve. The valve may also be an ordinary valve along with some means for closing the valve during the collision process.

Impact pressures are generated by the apparatus when the object 208 collides outside of the fluid with the piston 202 impacting on the fluid in the hydraulic cylinder. The impact pressures propagate with the sound speed into the subterranean reservoir formation 332 along with the fluid from the reservoir 232. Different embodiments of the apparatus 200 are described in more details later in relation to FIGS. 3, 5, and 8-14.

The flow from the one reservoir to the subterranean reservoir may be simply generated by the hydrostatic difference between the reservoirs or may alternatively or additionally be generated by pumping means. The apparatus for generating impact pressure may likewise be used to generate impact pressure in a non-flowing fluid.

A hydrostatic head between the reservoir 232 and the hydraulic cylinder 201 or alternatively or additionally the pumping means act to push the piston 202 towards its extreme position in between each impact by the object. Other means for moving the piston 202 back to its outset position after a collision may be applied if necessary. The piston extreme position in the depicted embodiment is its uppermost position. Means may be included in the system to prevent the piston 202 from moving out of the hydraulic cylinder 201. One end side of the piston 202 is in contact with the fluid. The piston 202 may be placed in the cylinder 201 with sealing means to limit the leaking of fluid between the hydraulic cylinder 201 and the piston 202.

As the piston is in contact with the fluid, the impact of the object with the piston induces a displacement of the piston 202 in the cylinder, which is proportional to the contact time during the impact between the object 208 and the piston 202 and the impact speed of the object 208 as explained above in relation to FIG. 1A. The displacement of the piston is therefore very small, barely visible, and insignificant if compared to how the piston should be forced up and down in order to make pressure pulses of measurable amplitudes by pulsating the fluid. Also, the apparatus employs an entirely different principle compared to e.g. seismic simulation tools where generally a load impacts an anvil of some sort placed against the solid matrix. In that case the impact is thus transferred to the solid, whereas here the impacted piston impacts on the fluid generating impact pressures in the fluid. The piston displacement caused by the impact of the object is rather due to a compression of the fluid just below the piston and not due to any forced motion of the fluid.

A hydrostatic head of significant size between the reservoir 232 and the hydraulic cylinder 201 as well as a large flow resistance in the conduits leading to and from the cylinder may also influence the contact time to be reduced. Such flow resistance could be due to many features of the conduits such as; segments with small cross section in the conduits, the length of the conduits, the flow friction at the walls of the conduits, and bends along the conduits.

However, the most important reason for a small contact time is the inertia of the fluid preventing any significant change in the motion of the fluid (or displacement of the piston 202) during the impact. The impact therefore mostly induces a cycle of compression in the fluid which is transmitted as an impact pressure from the hydraulic cylinder 201 as also explained in relation to FIG. 1C.

An impact pressure propagates in the fluid with the speed of sound moving (unless prevented to do so) towards both reservoirs 332 and 232 in itself not providing any net fluid transport between the reservoirs 232 and 332. FIG. 2 illustrates therefore a possible embodiment of an apparatus 200 for generating impact pressures, where the apparatus in itself does not induce any net fluid transport.

A short contact time results in large positive pressure amplitudes and very short rise times of the impact pressure. A reduction or minimization of the contact time (and thereby the displacement of the piston) is desirable to increasing the efficiency of the impact pressure generating system with respect to the obtainable pressure amplitudes, rise time and duration.

High amplitudes and short rise of the impact pressure is seen to be advantageous in hydrocarbon recovery operations enhancing the penetration rate in the subterranean reservoir formation 332 and suppress any tendency for blockage and maintain the subterranean reservoir formation in a superior flowing condition. This superior flowing condition increases the rate and the area at which the injected fluid from reservoir 232 can be placed into the subterranean reservoir formation 332. Hydrocarbon recovery operations often involves replacement of hydrocarbons in the subterranean reservoir formation with another fluid which in FIG. 2 comes from reservoir 232, and this exchange of fluids is enhanced by the impact pressure propagating into the subterranean reservoir formation.

Impact pressures with negative pressure amplitude may be generated as the impact pressures are propagating in the fluid and caused to be reflected in the system. Such negative amplitude could result in undesirable cavitations in the system, which may be prevented by a sufficient inflow of fluid from the reservoir.

Figure 3:
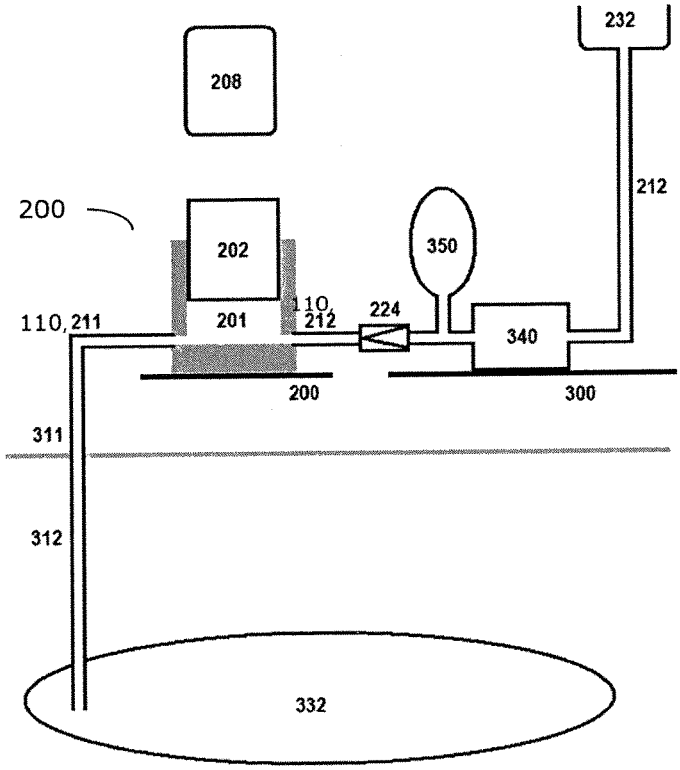

FIG. 3 outlines another embodiment of an impact pressure generating apparatus 200. Here, the apparatus is further coupled to a fluid transporting device 340 (such as a pump) and an accumulator 350 which is inserted in the conduit 212 between the valve 224 and the reservoir 232. Like in the previous FIG. 2, the apparatus is in fluid-connection to a subterranean reservoir formation 332 by the conduit 211 connected to a well head 311 of a well 312.

The fluid in reservoir 232 is flowing through the conduit 212, the fluid transporting device 340, the accumulator 350, the valve 224, the hydraulic cylinder 201, the conduit 211, the well head 311, the well 312, and into the subterranean reservoir formation 332. The fluid transporting device 340 is aiding in the transport of the fluid from the reservoir 232 and into the subterranean reservoir formation 332. The fluid from reservoir 232 is placed into the subterranean reservoir formation 332, or the fluid from reservoir 232 is replacing other fluids in the subterranean reservoir formation 332. The impact of the object 208 on piston 202 generates an impact pressure propagating into the subterranean reservoir formation 332.

The accumulator 350 acts to dampen out any impact pressure travelling from the hydraulic cylinder 201 through the valve 224 and towards the fluid transporting device 340, and thus preventing impact pressures with significant amplitude to interfere with the operation of the fluid transporting device 340. The accumulator 350 may also accommodate any small volume of fluid which may be accumulated in the conduit system during the collision process due to the continuous transporting mode of the fluid transporting device 340.

Figure 4A:
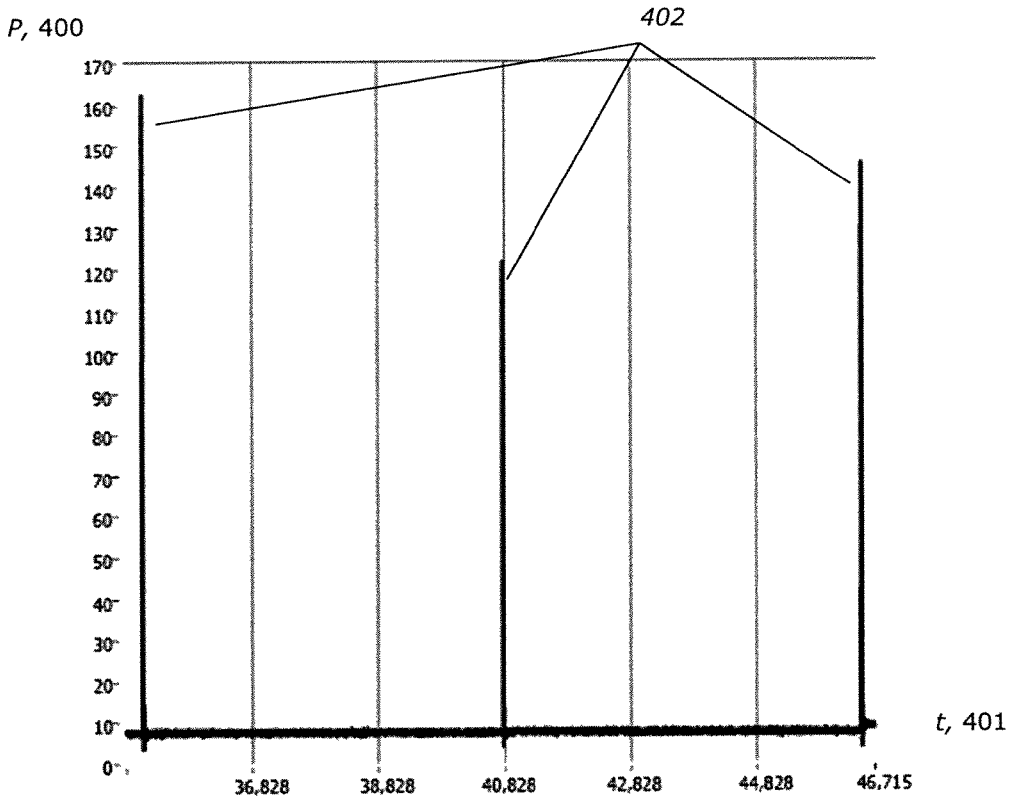
FIG. 4A illustrates the typical shape of an impact pressure obtained during experiments on Berea sandstone cores.
Figure 4B:
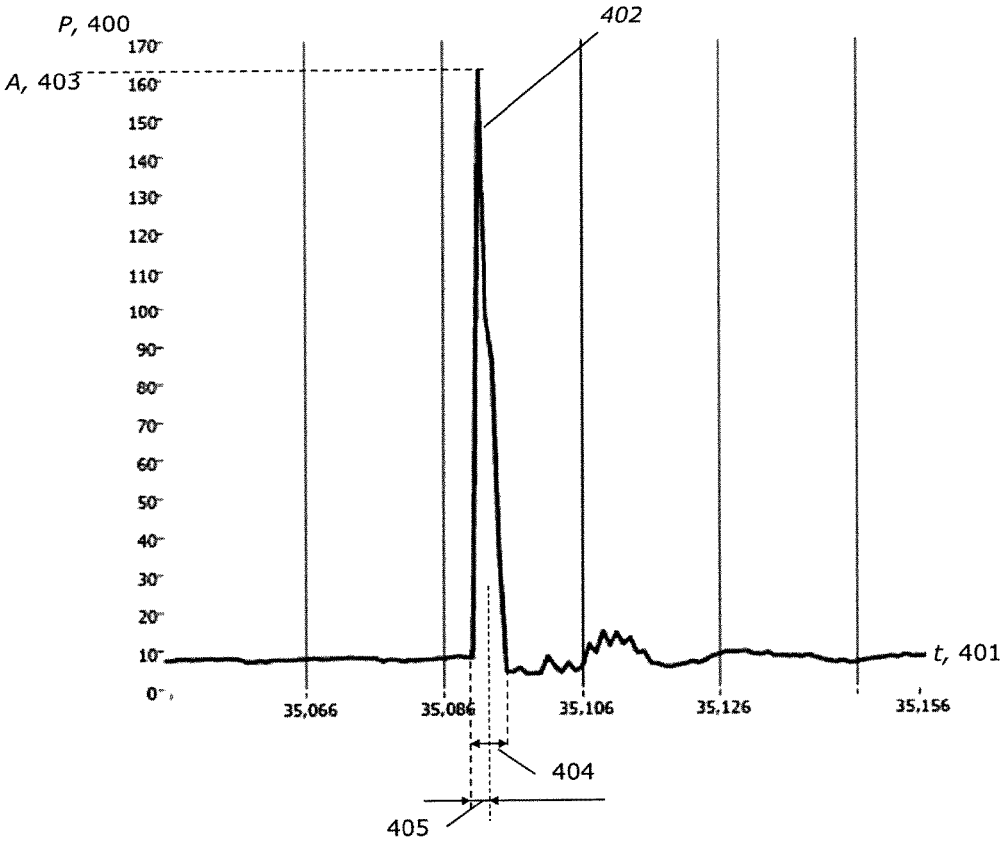
FIG. 4B shows a single impact pressure in greater detail as obtained and measured in the water flooding experiments on a Berea sandstone core, FIG. 5-6 provide a schematic overview of the configuration applied in experimental testing on Berea sandstone cores employing impact pressure.
Figure 5:
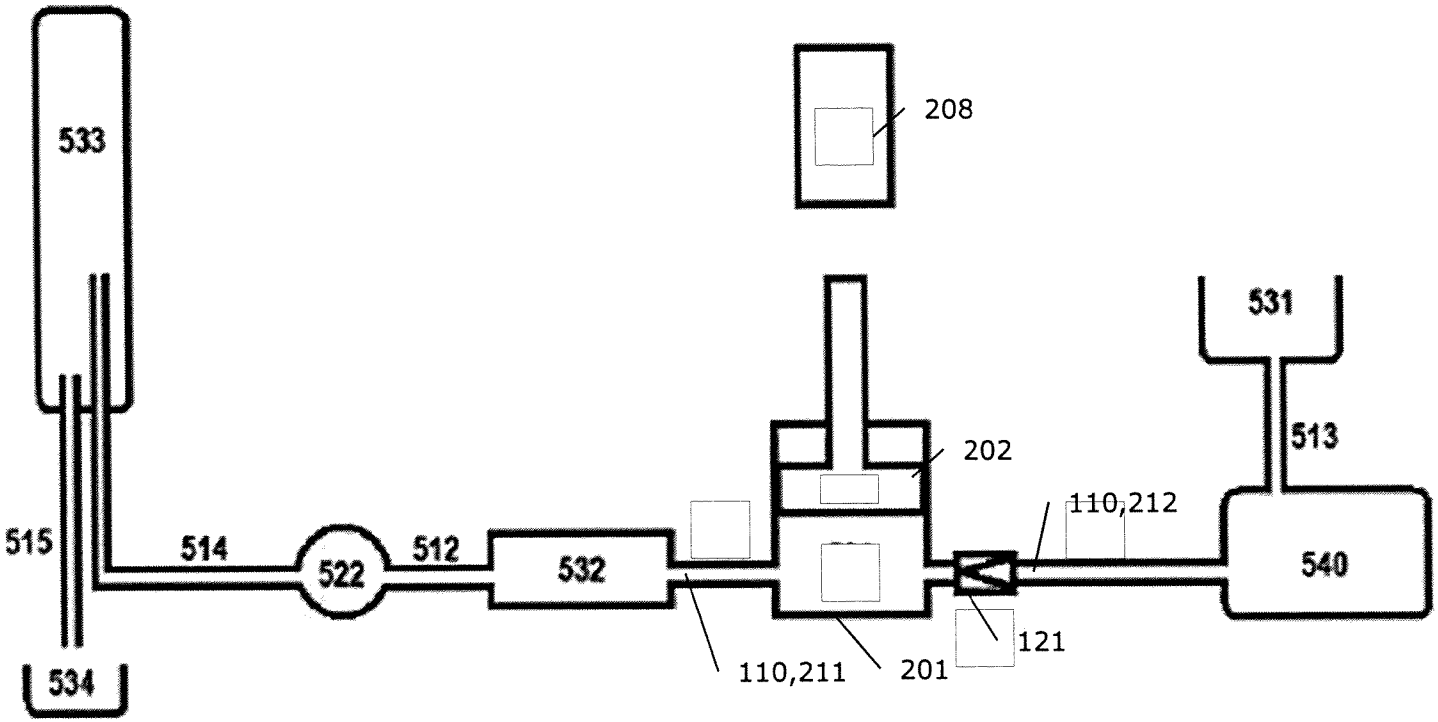
Figure 6:
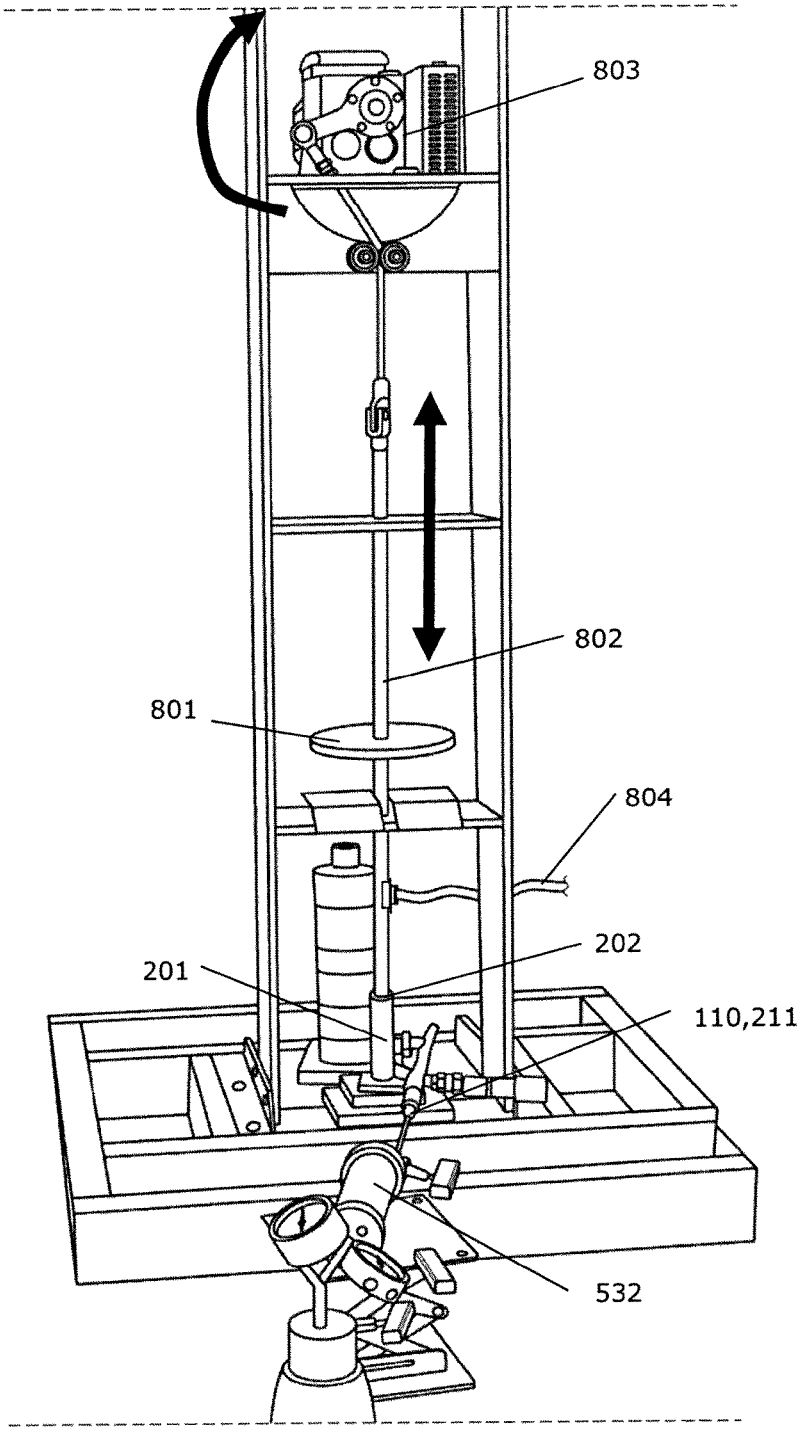

FIGS. 4A and 4B show an example of the pressure over time obtained by generating impact pressures on an apparatus as outlined in FIG. 5 and from an experimental set-up as sketched in FIG. 6.

FIG. 4A shows the pressure p, 400 in a fluid as measured at a fixed position and as a function of time t, 401 for a duration of time where 3 impact pressures 402 were generated. A single impact pressure is shown greater detail in FIG. 4B also illustrating a typical shape of an impact pressure 402 of a time duration or time width 404 from the impact pressure is generated to the pressure peak has passed, and with a rise time 405 from the impact pressure is detected until its maximum (amplitude, 403) is attained. In general impact pressures yields very high and sharp pressure amplitudes compared to the pressures obtainable by conventional pressure pulsing techniques. I.e. impact pressures in general yield considerably higher pressure amplitudes with considerably shorter rise time and considerably shorter duration of the impact pressure.

The experimentally obtained pressure plots in FIGS. 4A and 4B were obtained by a configuration as outlined in FIG. 5 used to generate impact pressures in flooding experiments on Berea sandstone cores.

Here, the impact pressures are generated by a collision process between the object 208 and the piston 202 impacting on the fluid in the cylinder 201. In the experimental setup a fluid pumping device 540 was connected to the pipelines 212 and 513. The reservoir 531 contained the salt water applied in the core flooding experiments. A Berea sandstone core plug is installed a container 532 which is connected to the pipelines 211 and 512. A back valve 522 is connected to two pipelines 512 and 514, and a tube 533 placed essentially vertically is applied for measuring the volume of oil recovered during the core flooding experiments. The tube 533 is connected by a pipeline 515 to a reservoir 534, where the salt water is collected.

During the experiments salt water is pumped from the reservoir 531 through a core material placed in the container 532. In these experiments Berea sandstone cores have been used with different permeabilities of about 100-500 mDarcy, which prior to the experiments were saturated with oil according to standard procedures. The oil recovered from the flooding by the salt water will accumulate at the top of the tube 533 during the experiments, and the volume of the salt water collected in the reservoir 534 is then equal to the volume transported from the reservoir 531 by the pumping device 540. The more specific procedures applied in these experiments follow a standard method on flooding experiments on Berea sandstone cores.

The pipeline 212 is flexible in order to accommodate any small volume of fluid which may be accumulated in the pipeline during the collision process between the piston 202 and the object 208 due to the continuous transporting of fluid by the pumping device 540.

The piston 502 is placed in the cylinder 201 in a bearing and the cylinder space beneath the piston is filled with fluid. In the experiments a hydraulic cylinder for water of about 20 ml is used. The total volume of salt water flowing through the container 532 was seen to correspond closely to the fixed flow rate of the pumping device. Thus, the apparatus comprising the hydraulic cylinder 201, the piston 202 and the object 208 contribute only insignificantly to the transport of salt water in these experiments. The collision of the object with the piston occurs during a very short time interval, and the fluid is not able to respond to the high impact force by a displacement which would have resulted in an increase of the flow and thus altering of the fixed flow rate. Rather, the fluid is impacted by the piston, and the momentum of the piston is converted into an impact pressure.

The impact pressure during the performed experiments were generated by an object 208 with a weight of 5 kg raised to a height of 17 cm and caused to fall onto the cylinder thereby colliding with the piston 202 at rest. The hydraulic cylinder 201 used had a volume of about 20 ml and an internal diameter of 25 mm corresponding to the diameter of the piston 202.

FIG. 6 is a sketch showing the apparatus used for performing the collision process and moving the object applied in the collision process in the experiments on Berea sandstone cores and of the experimental set-up as applied on the core flooding experiment on a Berea sandstone core as described in the previous.

The impact pressures are here generated by an impact load on the piston 202 in the fluid filled hydraulic cylinder 202. A mass 801 is provided on a vertically placed rod 802 which by means of a motor 803 is raised to a certain height from where it is allowed to fall down onto and impacting the piston 202. The impact force is thus determined by the weight of the falling mass and by the falling height. More mass may be placed on the rod and the impacting load adjusted. The hydraulic cylinder 201 is connected via a tube 212 to a fluid pump 540 which pumps salt water from 804 a reservoir (not shown) through the cylinder and through an initially oil saturated Berea sandstone core placed in the container 532. Pressure was continuously measured at different positions. A check valve 121 (not shown) between the pump and the cylinder ensures a one-directional flow. When having passed the Berea sandstone core, the fluid (in the beginning the fluid is only oil and after the water break through it is almost only salt water) is pumped to a tube for collecting the recovered oil and a reservoir for the salt water as outlined in FIG. 5.

Experiments were made with impact pressures generated with an interval of about 6 sec (10 impacts/min) over a time span of many hours.

The movement of the piston 202 caused by the collisions was insignificant compared to the diameter of the piston 202 and the volume of the hydraulic cylinder 201 resulting only in a compression of the total fluid volume and did not affect the fixed flow rate. This may also be deducted from the following. The volume of the hydraulic cylinder 201 is about 20 ml and the fluid volume in the Berea sandstone core in the container is about 20-40 ml (cores with different sizes were applied). The total volume which can be compressed by the object 208 colliding with the piston 202 is therefore about 50-100 ml (including some pipeline volume). A compression of such volume with about 0.5% (demanding a pressure of about 110 Bar since the Bulk modulus of water is about 22 000 Bar) represents a reduction in volume of about 0.25-0.50 ml corresponding to a downward displacement of the piston 202 with approximately 1 mm or less. Thus the piston 502 moves about 1 mm over a time interval of about 5 ms during which the impact pressure could have propagated about 5-10 m. This motion is insignificant compared with the diameter of the piston 202 and the volume of the hydraulic cylinder 201.

As mentioned above, FIG. 4A show the pressure in the fluid as measured at the inlet of the container 532 as a function of time for one of the performed experiments. The impact pressure were generated by an object 208 with a mass of 5 kg caused to fall onto the piston from a height of 0.17 m. Collisions (and thereby impact pressure) were generated at time intervals of approximately 6 s. Impact pressures were generated with pressure amplitudes measured in the range of 70-180 Bar or even higher, since the pressure gauges used in the experiments could only measure up to 180 Bar. In comparison, an object with a mass of about 50 kg would be needed in order to push or press (not hammer) down the piston in order to generate a static pressure of only about 10 Bar. The variations of the measured impact pressures may be explained by changing conditions during the cause of an experiment, as the fluid state (turbulence etc.) and the conditions in the Berea Sandstone vary from impact to impact.

A single impact pressure is shown greater detail in FIG. 4B also illustrating the typical shape of an impact pressure as obtained and measured in the laboratory water flooding experiments on a Berea sandstone core. Notice the amplitude 403 of about 170 Bar (about 2500 psi), and that the width 404 of each of the impact pressures in these experiments is approximately or about 5 ms, thereby yielding a very steep pressure front and very short rise and fall time. In comparison, pressure amplitudes obtained by conventional pressure pulsing by fluid pulsing have widths of several seconds and amplitudes often less than 10 Bar.

FIG. 7 is a summary of some of the results obtained in the water flooding experiments on Berea sandstone cores described in the previous. Comparative experiments have been conducted without (noted 'A') and with impact pressure (noted 'B') and are listed in the table of FIG. 7 below each other, and for different flooding speeds.

The experiments performed without impact pressure (noted 'A') were performed with a static pressure driven fluid flow where the pumping device 540 was coupled directly to the core cylinder 532. In other words the impact pressure generating apparatus 200 of the hydraulic cylinder 201 including the piston 202 and object 208 was disconnected or bypassed. The same oil type of Decan was used in both series of experiments.

The average (over the cross section of the core plug) flooding speed (in μm/s) is given by the flow rate of the pumping device. In all experiments the apparatus for generating impact pressure contribute insignificantly to the total flow rate and thus the flooding speed, which is desirable since a high flooding speed could result in a more uneven penetration by the injected water, and thus led to an early water breakthrough and viscous fingering. In the experiment 3B the set-up further comprised an accumulator placed between the hydraulic cylinder 501 and the fluid pumping device 540. An over pressure in this accumulator caused an additional pumping effect causing the high flooding speed of 30-40 μm/s as reported in the table. Ideally, this over pressure should have been removed. The result 3B included in FIG. 7 may be seen as demonstrating that improved oil recovery can be obtained even in the case of large flooding speed. In general, large flow rates result in viscous fingering and thereby lower oil recovery. This experimental result therefore indicates that the impact pressure prevented the development of viscous fingering explained by the impact pressure having a rise time and amplitude yielding a pressure difference overcoming the capillary resistance in the Berea sandstone core.

As seen from the experimental data, application of impact pressure to the water flooding resulted in a significant increase in the oil recovery rate in the range of approximately 5.3-13.6% (experiments 2 and 4, respectively), clearly demonstrating the potential of the proposed hydrocarbon recovery method according to the present invention.

An estimate of the contact time between the object and the piston and thus of the collision contact time may be obtained along the same line of derivations as outlined above in relation to FIG. 1C, only here for a theoretical collision process between a steel ball of 5 kg (with R=5.25 cm and Poisson's ration of about 0.28) and water. The total modulus of elasticity as written above becomes 0.39 GPa by employing a bulk modulus of 0.22 GPa for water and a modulus of elasticity of 215 GPa for steel. A contact time of the order 3.17 ms and a time width of about 4.8 ms are obtained by employing Hertz's impact theory. This can be compared to the measured time width of an impact pressure of about 5 ms in the experiments as measured from the experimentally pressure plots over time.

The experimentally measured time width of the impact pressure is thus in good agreement with the estimated value for the contact time and time width determined from Hertz' impact theory. As Hertz' impact theory only applies to solids having elasticity, the above use of a bulk modulus instead of elasticity modulus will only provide an estimate of the contact time for a collision process between a solid (with elasticity) and a fluid (with no elasticity), however a reasonable estimate.

A subterranean reservoir formation is a porous media which comprises a network of pore volumes connected with pore throats of different diameters (a) and lengths (l). The reservoir could contain oil and water, and the reservoir could be water wet, oil wet or mixed wet. The walls of the pore volumes and throats are mostly covered with water in a water wet reservoir. The dynamics of one fluid injected into the reservoirs, and thus displacing the fluids inside the reservoir, has been studied extensively in order to obtain improved oil recovery. The fluid injected is the invading fluid, and the fluids in the reservoir are the defending fluids. The fluids in the reservoir can experience (during water flooding) capillary resistance or push when flowing through pore throats. This is due to the surface tension between the fluids and the wetting condition of walls of the pore throats.

It may be assumed, that a capillary resistance (or a capillary pressure) of the order $Pc=\gamma/a$ must be overcome when water is pushed into oil wet pore throats filled with oil, or when oil is pushed into water wet pore throats filled with water. The surface tension $\gamma$ between water and oil is of the order of 0.01 N/m, and thus Pc equals 10-1000 Pa for $a=1-0.01\cdot10^{-3}$ m.

The water or the oil will move through the pore throat during a time which is of the order of the Rayleigh time $\tau_R=\sqrt{\rho a^3/\gamma}$ when the pressure difference over the length (l) of the pore throat is large enough to overcome the capillary resistance. Employing that the density is of the order 1000 kg/m$^3$, one obtains that $\tau_R=0.01-10\cdot10^{-3}$ s for $a=1-0.01\cdot10^{-3}$ m.

The pressure difference over the length of the pore throats must be of the order of $P_C$, and hence one needs to estimate the pressure difference that the impact pressure could provide over a pore length of the order of $l=1-0.01.1\ 0^{-3}$ m. An impact pressure with a rise time ($\Delta t$) of about one ms (the time that the pressure increases from zero to the maximum amplitude) and a maximum amplitude (I) of about 150 Bar would provide a pressure difference of 150 Bar over a length of 1.5 m (due to the pressure moving with the speed of sound (c) in the fluid of 1500 m/s). Hence, the impact pressure can maintain a pressure difference ($\Delta P$) of order 100–10000 Pa (for $a=1-0.01-10^{-3}$ m) over the length of a pore throat during a time period of about one ms. The pressure difference ($\Delta P$) can be expressed as $\Delta P=Ia/(c\Delta t)$, and in many cases $\Delta P$ is sufficient to overcome the capillary resistance. Moreover, a duration of the pressure $\Delta P$ equal to $\Delta t$ is often sufficient when comparing with the Rayleigh time $\tau_R$. The criteria for overcoming the capillary resistance can also be expressed as $Ia/(c\Delta t)>Pc$ or $$I > \frac{\gamma c \Delta t}{a^2}$$

The porous media in most reservoir formations of interest for hydrocarbon recovery operations has a pore diameter distribution with a peak value in the range $0.1-0.01.1\ 0^{-3}$ m. Employing the median pore diameter would be a good estimate of the pore throat diameter that is contributing mostly to the capillary resistance of the porous medium.

In comparison, a pressure pulse (with amplitude of 150 Bar which is very high if not unrealistically high for most conventional pressure pulsing technologies) which may be seen to normally have a rise time of perhaps about one second, can only maintain a pressure difference of about 0.1–1 Pa over the length of a pore throat during a time period of one second. This is in most cases not sufficient in order to overcome the capillary resistance, and the duration of about one second is unnecessarily large compared with the Rayleigh time $\tau_R$.

The speed at which the fluid is injected during water flooding determines if the invading fluid causes a capillary or viscous fingering in the reservoir. The speed U can be calculated with the Darcy relation $U=\kappa\Delta p/(\mu L)$, where $\kappa$ is the permeability, $\mu$ is the viscosity (of the order 30 mPas for oil, where mPas=$10^{-3}$ Pascal*second) and $\Delta p$ is the pressure difference over the distance L. Capillary fingering will normally be obtained with a flow speed $U=10^{-6}$ m/s when the permeability is of the order of $100\cdot10^{-3}$ D (Darcy=9, $869\cdot10^{-13}$ m$^2$). Viscous fingering would result in reduced oil recovery, and hence it is important that $\Delta p$ does not become too large. Employing the values above, one can estimate that $\Delta p$ is on the order of 3 Bar over a distance of L=1 m.

In case of employing impact pressure during water flooding, $\Delta p$ is to be replaced by $\Delta p+\langle P_I\rangle$ in the Darcy relation above. The number $\langle P_I\rangle$ is the time average of the impact pressure $P_I$, and thus it is advantageous that the time average of the impact pressure is insignificant. An impact pressure with a duration of the order one ms and maximum amplitude of about 150 Bar would give a time average of the order 0.015 Bar if one impact pressure is generated every 10 second. A pressure pulse (with the same amplitude of about 150 Bar) with duration of about one second has a time average of 15 Bar if one pressure pulse is produced every 10 second. Thus, employing pressure pulses during water flooding could result in viscous fingering, whereas the time average of impact pressure would contribute only insignificantly in the Darcy relation.

In summary, employing pressure stimulations such as impact pressure during water flooding is advantageous when it comes to obtaining improved oil recovery. This may be explained by the high pressure in combination with the short rise time (and the duration) of the impact pressure provides a sufficient pressure difference over the length of a pore throat which can overcome the capillary resistance. Further, the pressure difference can be maintained over a sufficiently long time (close to the Rayleigh time), providing for the fluid interface (causing the capillary resistance) to pass through the capillary throats. Moreover, the short rise time of the impact pressure ensures that the time average of the impact pressure do not contribute significantly in the Darcy relation. Employing impact dynamics (a collision process) is a simple and efficient method for generating pressure stimulations with short rise time and for maintaining a sufficient pressure difference for a time period as close to as within 1-100 times the Rayleigh time, which may be explained by the short contact time (estimated by applying the impact theory of Hertz) and of the same order or within 1-100 times the Rayleigh time.

Figure 8A:
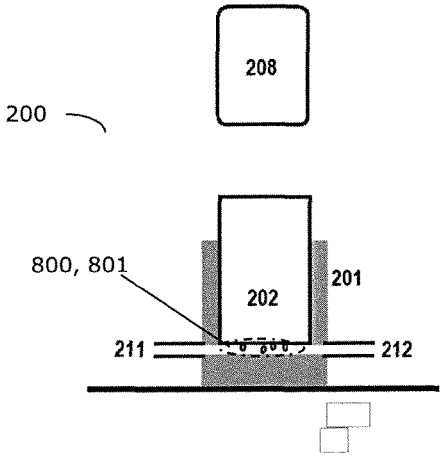
FIGS. 8-14 show different embodiments of the impact pressure generating apparatus according to the invention.
Figure 8B:
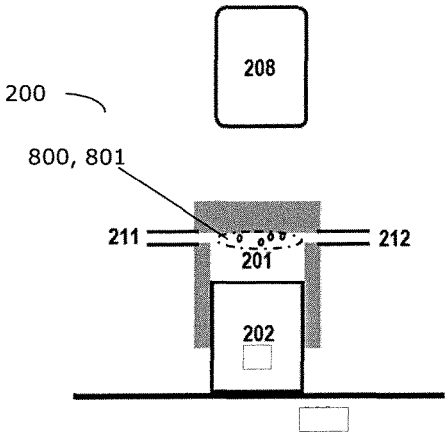

FIGS. 8A and 8B outline different embodiments of apparatuses 200 for the generation of impact pressures. The apparatus 200 comprises the following components; a fluid-filled chamber which may be in the shape of a cylinder 201 with two openings, a piston 202 movably placed inside the chamber 201, first 211 and second 212 conduits that are connected to the openings in the hydraulic cylinder 201, and an object 208 which can collide with the piston 202 thereby impacting on the fluid primarily in the part 801 of the chamber. The hydraulic cylinder 201 may be bolted to a heavy platform or to the ground. In this embodiment, the piston 202 is placed in the cylinder such that its lower end (in its uppermost position) is placed just at or in proximity to the upper edge of the openings in the hydraulic cylinder 201. The apparatus 200 in FIG. 8B comprises the same components as the system described in relation to FIG. 8A, only now the chamber with the piston placed inside is turned around relative to the ground, such that the object 208 is caused to collide with the chamber impacting on the fluid in therein. The small vertical displacement of the hydraulic cylinder 201 during the impact of the object 208 does not result in a restriction on the water flow. In order to accommodate any possible vertical displacement of the hydraulic cylinder 201, segments of the conduits 211 and 212 may be made flexible.

In general, the fluid flowing from conduit 212 (through the hydraulic cylinder 201) and towards the conduit 211 may contain a mixture of fluids or other dissolved fluids. In most cases, the system will inevitably comprise inclusions of gas, for instance air bobbles dissolved in a water fluid. Such air inclusions are almost always present from the start in fluid systems and can travel around the system with the fluid if not carefully removed e.g. by venting. Also, air bubbles may be produced in the water due to turbulent flow, or due to the impact by the object 208 on the piston 202.

Such gas inclusions in general will tend to gather in an uppermost zone in the apparatus due to the influence of the gravitational forces as gas bubbles will rise up in the fluid. In the apparatus sketched in FIGS. 8A and B these small gas inclusions such as air bubbles would naturally gather in a zone 800 in the uppermost part of the cylinder below the piston 202. Here, unless prevented, gas-inclusions may accumulate over time forming a build-up of gas inclusions, ultimately producing large air bubbles.

Due to the higher compressibility of the gas-inclusions compared to the fluid, gas-inclusions situated below the piston 202 impacting on the fluid in the chamber would increase the contact time and the displacement of the piston 202 during the impact. The higher the amount of gas-inclusions that is present, the larger displacement of the piston and the higher the contact time is obtained. This is disadvantageous when it comes to generating impact pressures with large amplitude and short rise time and duration, where it is important to keep the contact time as short as possible.

Therefore, any build-up and accumulation of gas-inclusions in the zone 800 should be reduced or avoided in the part of the chamber where the fluid is directly impacted, 801. In the embodiments of FIGS. 8A and B this is obtained by arranging the outlet 211 from the chamber next to the zone 800, where the gas-inclusions will gather. Hereby, the gas-inclusions such as air bubbles will be pushed out of the hydraulic cylinder 201 by the water flowing from conduit 212 and towards conduit 211. In these embodiments, the build-up of gas-inclusions in the chamber is further reduced or even prevented by also arranging the inlet next to of in close proximity to where the fluid is impacted by the collision process, thereby improving the through-flow in this part 801 of the chamber.

Figure 9A:
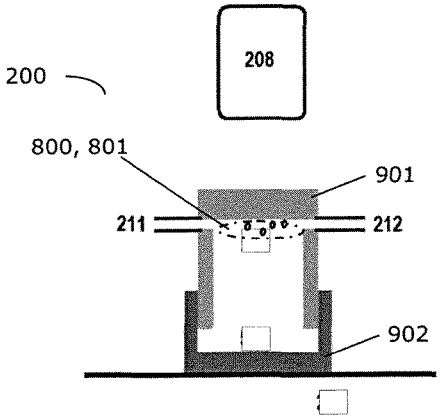

FIGS. 9A and B show two embodiments of an apparatus 200 for impact pressure generation where the two wall parts 901, 902 of the chamber movable relative to each other are formed by to cylinders inserted one inside the other. Sealing means are included in the system in order to limit the leaking of fluid between the cylinders 901 and 902. Further, means may be included in the system to prevent the cylinder 901 from moving out of the cylinder 902 due to a fluid pressure overcoming the weight of the cylinder 901 and any friction in the sealing means.

Figure 9B:
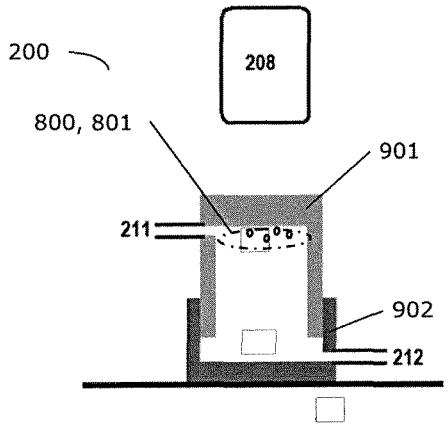

In the embodiment of FIG. 9A, both the inlet 212 and the outlet 211 are placed in the cylinder 901 impacted by the object 208. The placement of the in- and outlet in relation to the zone of gas-inclusions 800 reduce or avoid any build-up of such gas-inclusions where the fluid is impacted 801. In the embodiment of FIG. 9B, the inlet 212 is placed in the cylinder 902 and the outlet 211 is placed in the cylinder 901 impacted by the object 208.

Figure 10A:
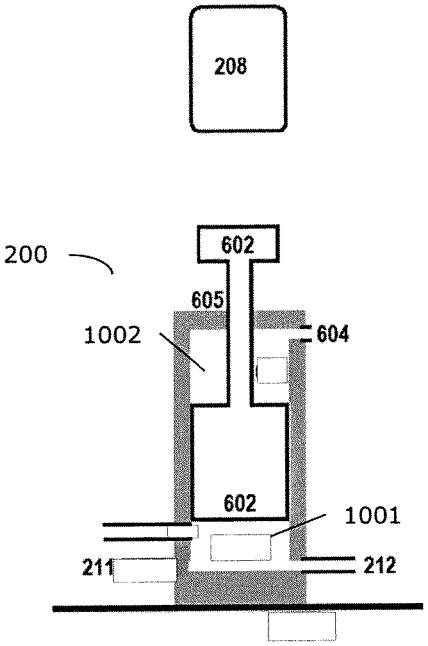

FIGS. 10A, B, and C outline another embodiment of the impact pressure generation according to the invention. The apparatus 200 here comprise a piston 602 placed inside a cylinder 601, where the piston 602 divides the cylinder 601 into two compartments 1001, 1002. The piston 602 extends out of the hydraulic cylinder 601 through an opening 605 in the second compartment 1002. First 211 and second 212 conduits are connected to the two openings in the first fluid-filled compartment 1001. An object 208 is arranged to collide with the piston 602 thereby impacting on the fluid in the first compartment 1001 generating an impact pressure propagating in the conduits 211 and 212, corresponding to the previously disclosed embodiments. Sealing means between the piston 602 and the cylinder walls may be included in the system in order to limit the leaking of fluid between the compartments.

Further, means may be included in the system to prevent the piston 602 from moving above an extreme position counteracting the pressure of the fluid. Such means may simply be that some part of the piston 602 inside the cylinder cannot move through the opening 605.

The opening 604 is allowing a fluid (for example air) to flow or be guided in and out of the second compartment 1002 during the mode of operation to adjust or control the pressure in the second compartment 1002. The opening 604 may in one embodiment be closed during the mode of operation thereby compressing and decompressing the fluid in the second compartment.

In this way the pressure behind the piston may e.g. be controlled such as to outbalance fully or partly the pressure in the fluid prior to the collision by the object. This then increases the amount of energy which will be converted into impact pressure.

Figure 10B:
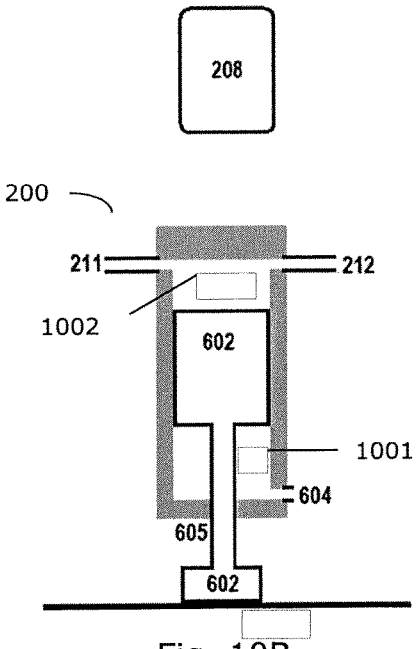
Figure 10C:
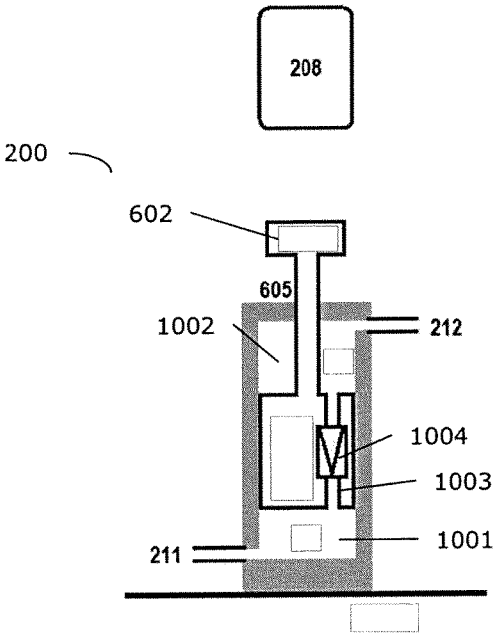

FIG. 10B shows an embodiment of an apparatus comparable to the one in FIG. 10A only here the orientation of the system is different and the object 208 is caused to collide with the hydraulic cylinder.

FIG. 10B shows an embodiment of an apparatus comparable to the one in FIG. 10A only here the piston 602 comprises a flow channel 1003, so that fluid can flow between the compartments 1001, 1002 making it possible arrange the inlet 212 in the second compartment 1002. A one-way valve 1004 is installed in the flow channel only allowing a flow from the second compartment and into the first compartment. Due to the flow channel 1003 in the piston the pressure in the two compartments on both sides of the piston is the same, and the piston is thereby not moved by the pressure in the fluid regardless of the hydrostatic pressure in the system. The collision by the object 208 on the piston only induces a downward motion, and other means for moving the piston to the its initial uppermost position prior to the next impact may therefore be applied.

FIGS. 11-14 illustrates different embodiments of an apparatus for impact pressure generation according to the invention. In these embodiments the zone 800 where any gas-inclusions in the fluid gather due to the gravitational forces has been positioned in the apparatuses away from the part of the chamber where the fluid is impacted 801.

Figure 11:
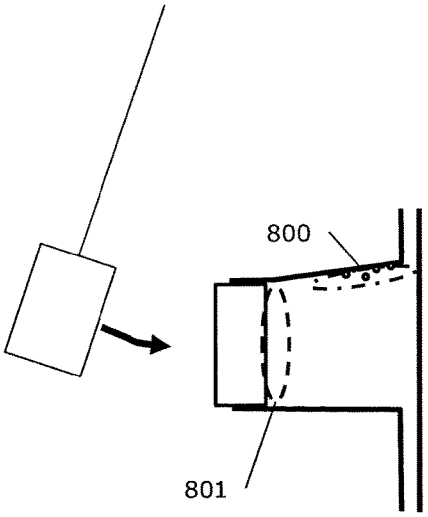

In FIG. 11, an object is caused to collide with a first wall part arranged in a non-horizontal side of the fluid-filled chamber, whereas any gas-inclusions gather in a zone 800 in the uppermost part of the chamber.

Figure 12:
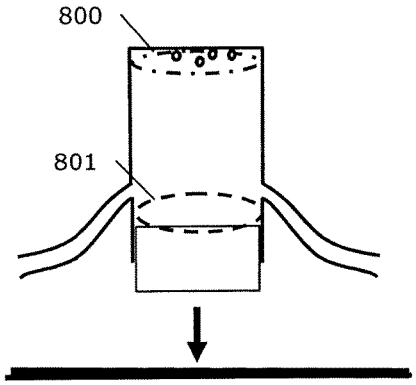

In FIG. 12, the entire chamber is caused to fall down on the object (such as the ground). The fluid is thereby impacted during the collision process mainly in the lowermost part 801 of the chamber, whereas any gas-inclusions naturally gather in a zone 800 in the uppermost part of the chamber.

Figure 13:
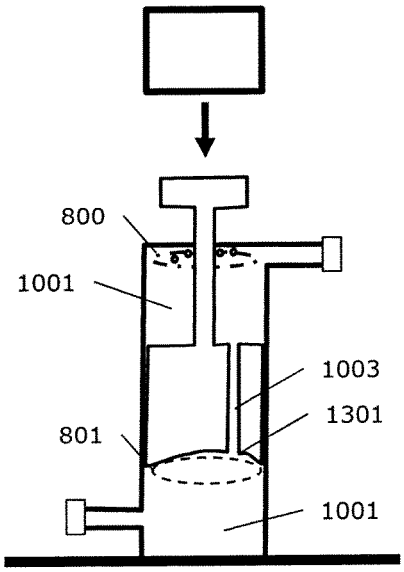

In FIG. 13, the piston comprises a flow channel 1003. Further its lower surface towards the fluid impact zone 1301 is concave so that gas-inclusions in the first compartment 1001 will move up the flow channel to gather in a zone 800 in the second compartment away from the impacting zone 801.

Figure 14:
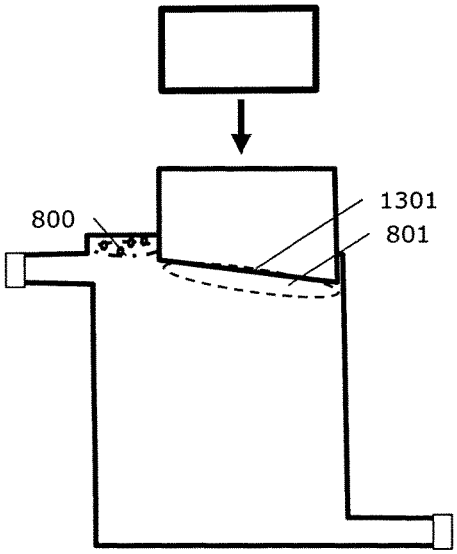

In FIG. 14, the surface of the piston towards the fluid impact zone 1301 is skewed relative to horizontal so that gas-inclusions will rise and move to a zone 800 outside where the piston impacts on the fluid 801.

Invasion percolation is the complex phenomena observed when one fluid displaces another fluid in a porous media such as during hydrocarbon recovery from a porous medium in a reservoir by fluid injection. The method described in this document is based upon both theoretical and experimental studies on invasion percolation, and some result will be disclosed in what follows.

Stimulated invasion percolation experiments have been performed on a two-dimensional porous media as illustrated in FIGS. 15-20. A 2D porous media shown in FIGS. 16-20, was made of a random tightly packed monolayer of glass beads 1600 with a diameter of 1 mm, and placed between two glass plates, 1601. Steel plates 1602 and beams 1603 were applied to hold the glass plates firmly in place during pressurizing of the 2D system. Four windows 1604 in the steel plates 1602 allow pictures to be taken of the structures emerging when an invading fluid displaces a defending fluid in the tightly packed monolayer of glass beads.

The width and length of the 2D system are 250 mm and 1000 mm, respectively. The effective width W is about 230 mm due to sealing means along the edges. An olive oil with a viscosity of about 0.084 Pa·s is used as the defending fluid, and water with a viscosity of about 0.001 Pa·s is applied as the invading fluid during the fluid injection. The surface tension $\gamma$ between water and the olive oil is about 0.0186 N/m, and the permeability k of the 2D system is measured to be about $2\cdot10^{-9}$ $m^2$. Initially, the glass beads are placed and closely packed in between the glass plates forming the 2D porous medium. Several drainage and imbibition processes are performed to saturate the 2D system with water and olive oil, and initially the original olive oil in place (OOIP) is about 80% of the total volume of fluid in the 2D system. The invading fluid (the water) was then injected into the porous medium through an inlet port 1607 placed centrally at the one end of the 2D system by means of a fluid pump (not shown) and with a controllable flow rate.

Invasion percolation experiments of which results are shown in FIGS. 17-20 were performed with and without impact pressure generation and in all cases with a fixed constant flow rate of 0.08 liters per hour (80 ml/h) giving an average flow rate U over the cross section (1 mm times 230 mm) of about $9.7\cdot10^{-5}$ m/s or 35 cm/h. The capillary number Ca defined as the ratio between the Darcy pressure ($Pd=\mu rU/k$) and the capillary pressure ($Pc=\gamma/r$), yields $Ca=\mu Ur^2/k\gamma$, which is about 0.014 in these invasion percolation experiments. The pore throat radius r is illustrated in FIG. 21, and estimated to be about 0.25 mm.

Figure 15:
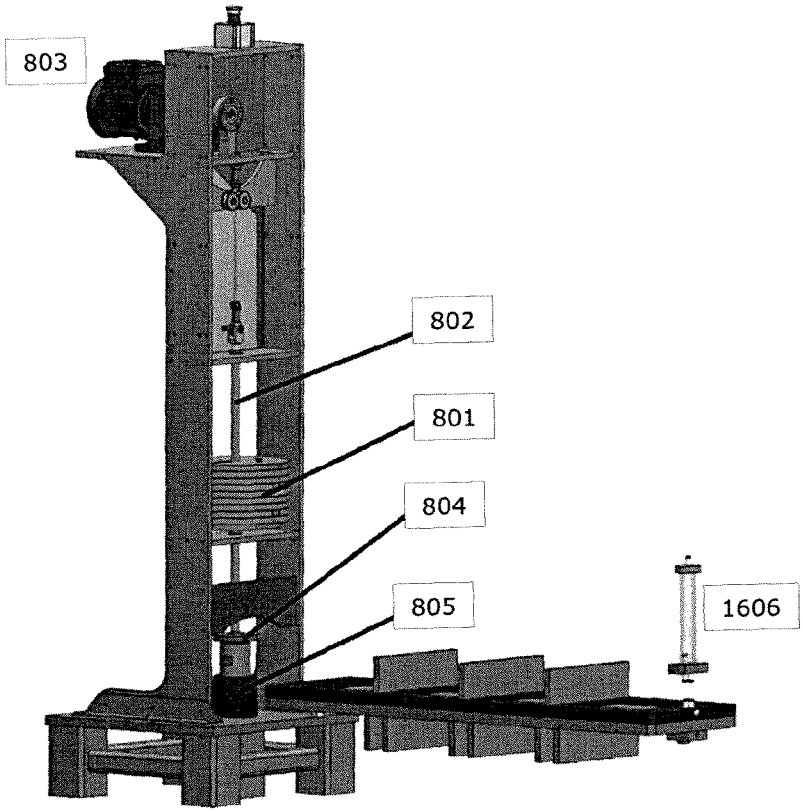
FIGS. 15-16 show an experimental set-up for generating impact pressure according to embodiments of the invention.
Figure 16:
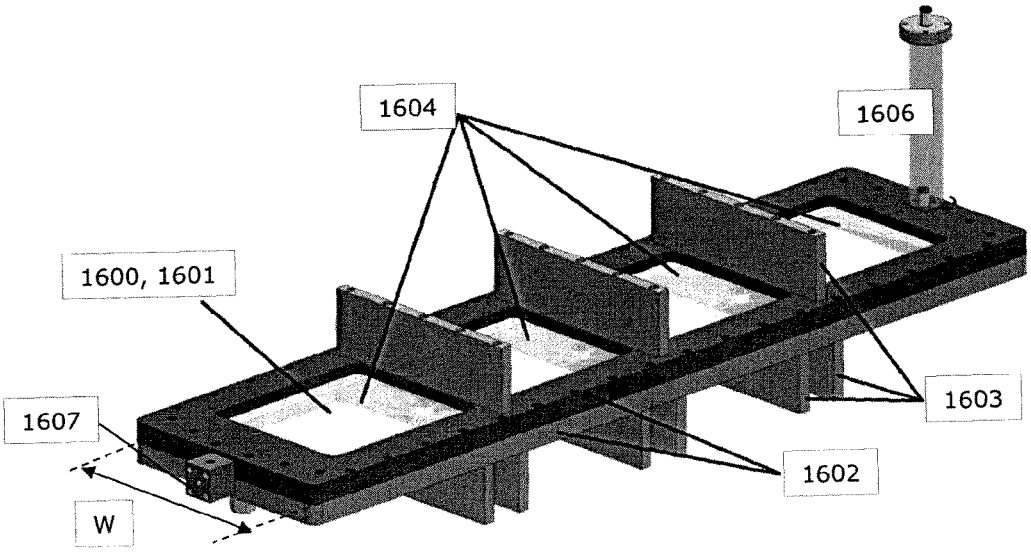

The invasion experiments were repeated with a pressure stimulation applied to the injection fluid in the form of impact pressures. The impact pressure is produced in the described experiments by an impact on a piston 804 in a fluid filled hydraulic cylinder 805 as illustrated in FIG. 15, and of the same type as the system described in relation to FIG. 6. A mass 801 of 5 kg is provided on a vertically placed rod 802 which, by means of a motor 803, is raised to a certain height from where it is allowed to fall down onto the piston 804. The injection flow rate was unaffected by the impact pressure generation. The pressure impacts were repeated every 10 seconds. The invading fluid (water) is pumped through conduits (not shown) into the hydraulic cylinder 804 and then into the 2D porous system through inlet 1607. Both the invading and the defending fluids end up in a cylinder 1606 from which the amount of defending fluid displaced during the invasion percolation experiments is measured yielding the recovery factor (% of OOIP).

During all experiments pictures were taken with digital cameras through the windows in the steel plates 1604 of the displacement structures that emerge during both pressure-stimulated and non-stimulated invasion percolation.

Figure 17:
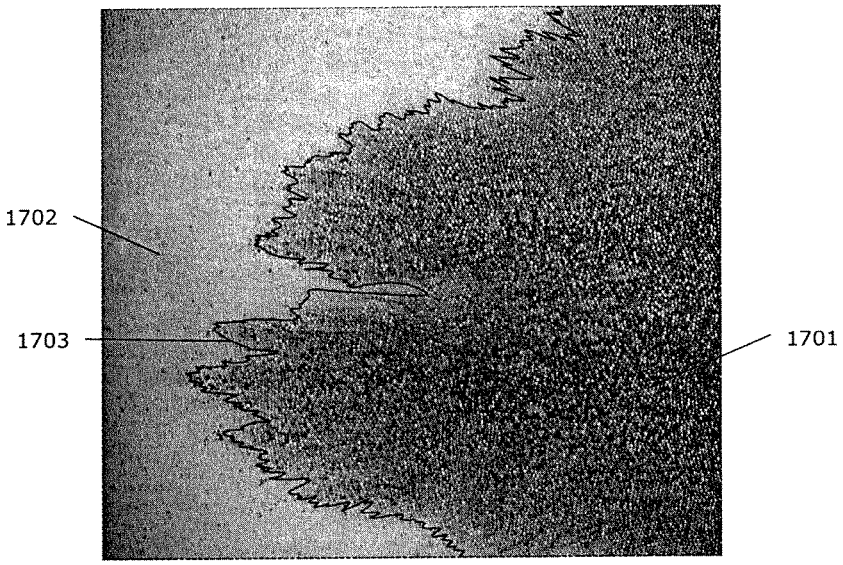
FIGS. 17 and 18 show experimental results of fluid oil recovery from a 2D porous medium with and without impact pressure generation according to the invention, respectively.
Figure 18:
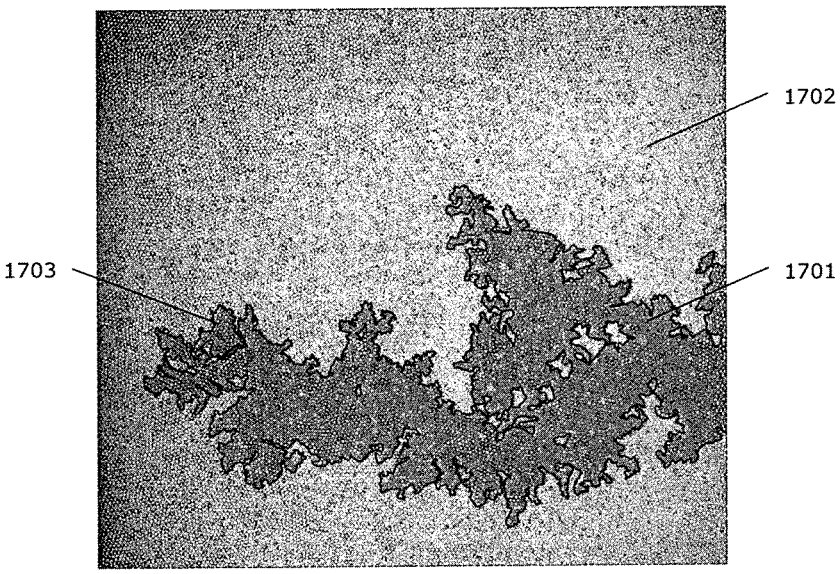
Figure 17B:
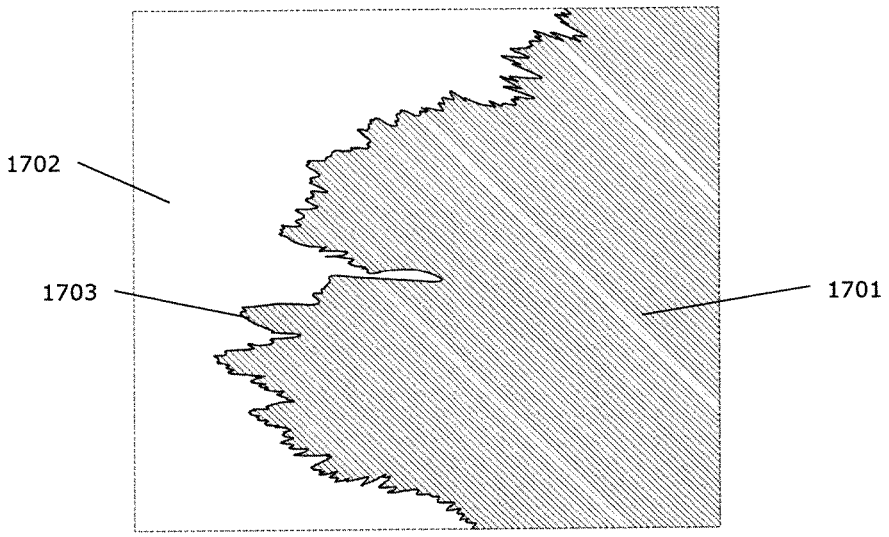
Figure 18B:
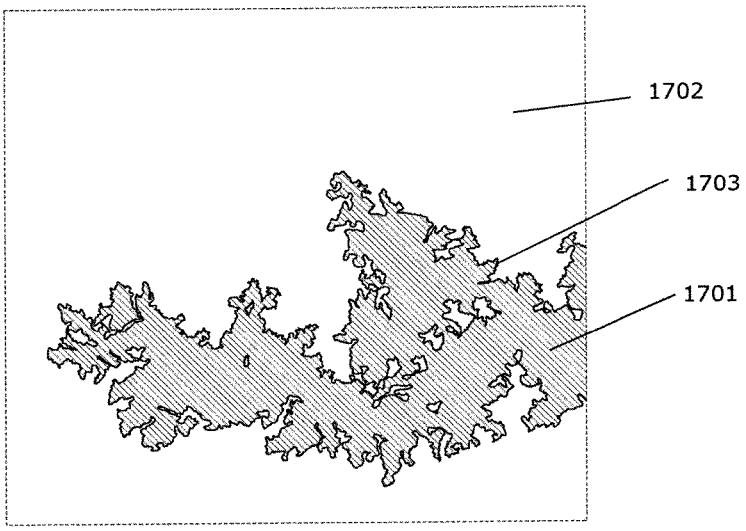

FIGS. 17 and 18 show the resulting displacement structures resulting from the experiments with (FIG. 17) and without (FIG. 18) impact pressure stimulation, respectively. The dark colour 1701 shows the invading fluid (water) between the glass beads 1600, and the light colour 1702 shows the defending fluid (olive oil). FIGS. 17B and 18B show the same results only in a drawn up representation with a drawn up contour line 1703 showing the front of the invading fluid. These pictures were taken approximately one hour after having initiated the fluid injection and are representative results of the characteristic displacement structures emerging with and without impact pressure stimulation.

As can be seen from the pictures of FIGS. 17 and 18, the impact pressure stimulation has a significant effect on the invasion percolation. Also, the recovery factor with impact pressure stimulation (FIG. 17) is measured to about 65% and thus much larger than what was obtained for the standard non-stimulated invasion percolation (FIG. 18) yielding a recovery of only about 35%.

Figure 19:
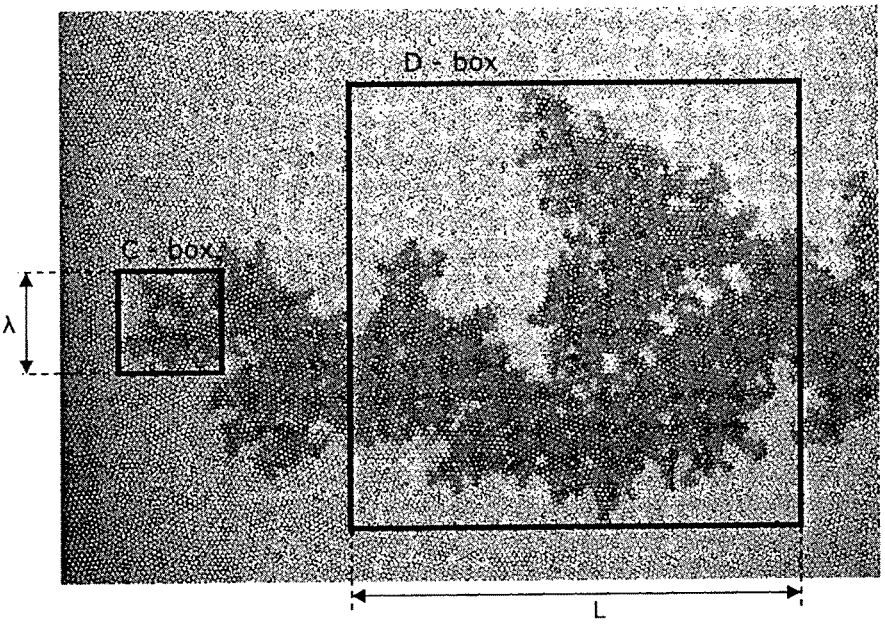
FIGS. 19-20 show the result of FIG. 18 in greater enlargements.
Figure 20:
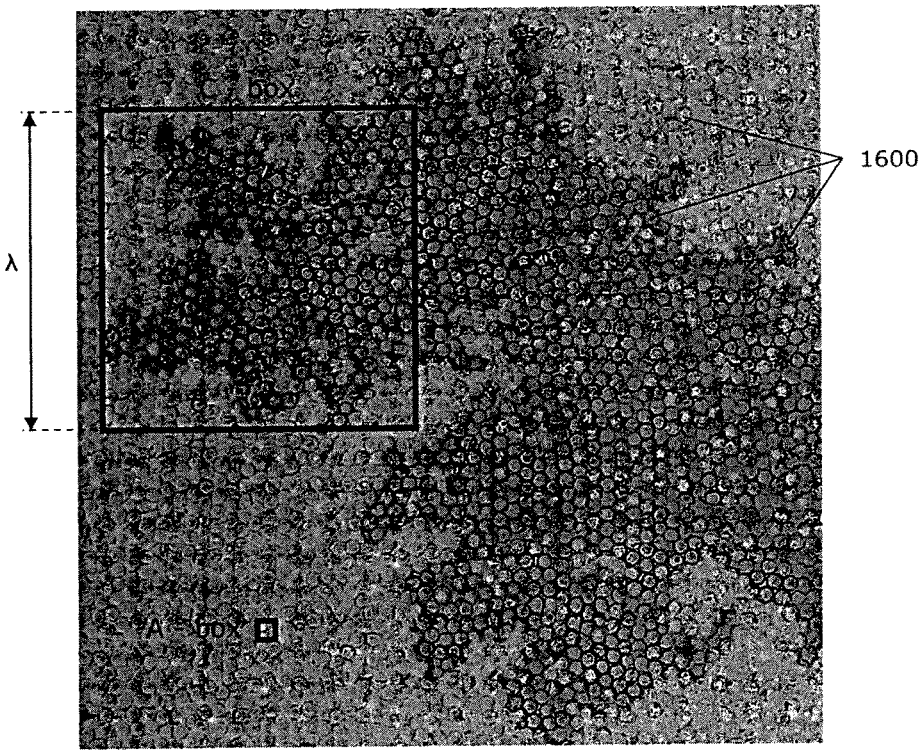
Figure 21:
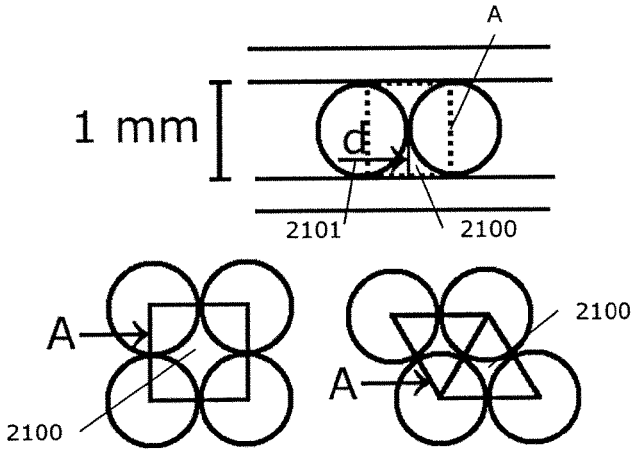
FIG. 21 illustrates two characteristic pore configuration of the 2D experimental pore medium as seen from above and from the side.

FIGS. 19 and 20 show areas of the displacement structure shown in FIG. 18 in enlargements, i.e. for the invasion percolation without any impact pressure stimulation.

In the enlargement in FIG. 20 the glass beads 1600 forming the 2D porous medium are clearly visible with the coloured fluids filling the pores between the beads.

There are four different scales during invasion percolation without any impact pressure stimulation as identified by the A-, C-, D- and W-boxes shown in the FIGS. 19-20.

The most important scale is the scale where capillary fingering is observed, and this occurs inside the C-box as indicated in FIG. 19 and in greater enlargement in FIG. 20. The length of the sides in the C-box can be determined from the following arguments. The Darcy relation provides an expression for the Darcy pressure $Pd=\mu\lambda U/k$, where $\lambda$ is the length of the C-box, $\mu$ is the viscosity of the olive oil and k is the permeability of the 2D system. In the case of capillary fingering, the Darcy pressure is of the order of the capillary pressure ($Pc=\gamma/r$), and thus one can assume that $\mu\lambda U/k\sim\gamma/r$. The length $\lambda$ of the C-box is then given by $\lambda=r/Ca$, where Ca is the capillary number (which is defined as the ratio between the Darcy pressure and the capillary pressure on the length scale equal to the pore throat radius r). The length of the C-box is limited by the fact that the Darcy pressure must overcome the capillary pressure.

FIG. 21 illustrates two different characteristic configurations of a pore volume 2100 of the 2D porous system in the experiments as seen from above and from the side, respectively. The square pore volume has 8 pore throats and the triangle has 6 pore throats entering each pore volume. As can be seen from the top view in FIG. 21, the diameter d of a pore throat 2101 into the pore 2100 can be estimated to be about equal to the radius of the glass beads of 0.5 mm, and thus $r=d/2=0.25$ mm. A further important scale during the invasion percolation is the pore volume scale (the A-box) which is indicated as the A-box in FIG. 20. The diameter of the glass beads are 1 mm, and hence one could argue that A=1.0 mm. However, there are some distance between the glass beads and some variations in the diameter of the glass beads. This makes A slightly larger and the length A of the A-box is estimated to be about 1.1 mm.

The invasion percolation experiment illustrated in FIGS. 18-20 has (as determined in the above) a capillary number Ca of about 0.014, and hence a length $\lambda$ of the C-box of $\lambda\sim18$ mm. The length L of the D-box is estimated to be 81 mm (about 4.5 times as large as X), which implies that $L\sim0.35$ W [9] (where W is the effective width of the experimental 2D system). To summarise, the four different scales during the invasion percolation identified by the A-, C-, D- and W-boxes, and there are about 268 (ratio 16.4) A-boxes inside the C-box, and there are about 20 (ratio 4.5) C-boxes inside the D-box, and finally there are about 8 (ratio 2.9) D-boxes inside one W-box.

The displacement structure that emerges during invasion percolation is a fractal [1]. The recovery factor during invasion percolation can be estimated theoretically by applying the fractal dimension indexes for capillary [2] and viscous [3] fingering of 1.83 and 1.53, respectively. The number of A-boxes invaded by the invading fluid (water) may then be determined as $16.4^{1.83}=167$, which is about 62% of the A-boxes inside the C-box, whereas the number of C-boxes invaded is $4.5^{1.53}=10$ or 50% of the C-boxes in the D-box. The total number of invaded A-boxes in the 2D system is therefore $0.50\cdot0.62=0.31$, which can be seen to be in good agreement with the measured recovery factor of about 35% for the injection experiments without impact pressure stimulation.

Figure 22:
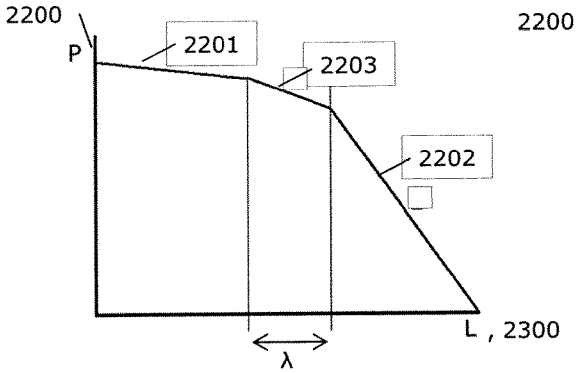
FIGS. 22-23 are sketches of the pressure distribution as a function of the length in the D- and C-regimes, respectively.
Figure 23:
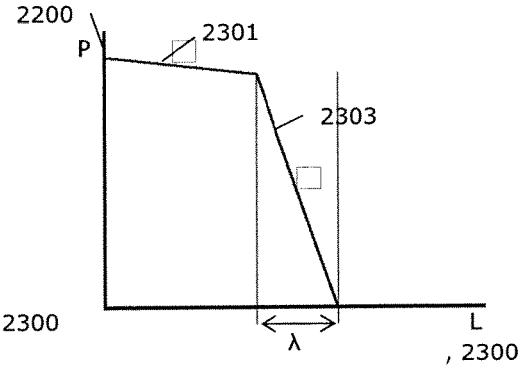

FIGS. 22 and 23 illustrate the pressure distribution P 2200 over a length L 2300 corresponding to the length of the D-box, for the D and the C-regimes, respectively. The Darcy pressure Pd is fluctuating between two different regimes (D and C). The D-regime (FIG. 22) provides a Darcy pressure difference (DPD) over the length L of the D-box that overcomes the viscosity forces and maintains a fluid flow through the D-box. This viscous fluid flow results in viscous fingering structures in the D-box. One C-box (indicated with the thin vertical lines) with length $\lambda\sim18$ mm is illustrated in FIG. 22, and the DPD (slope 2201) on the upstream side providing a flow of the invading fluid into the C-box is smaller than the DPD (slope 2202) on the downstream side providing a flow of the defending fluid out of the C-box. The reason for this is that there is a difference in the viscosity of the invading fluid (water) and the defending fluid (olive oil); hence a larger DPD is needed to maintain a fluid flow of the defending fluid out of the C-box. The slope 2203 is the DPD needed to displace both invading and defending fluids inside the C-box. As the available DPD is predetermined for a given flow rate U and as the DPD is required to be larger than the capillary pressure in the C-box, the length $\lambda$ of the C-box is limited.

FIG. 23 illustrates the C-regime where the DPD (slope 2301) maintain a flow of the invading fluid into the C-box (indicated with the thin vertical lines), only now there is no flow of fluid out of the C-box, and the DPD (slope 2303) inside the C-box is close to the capillary pressure Pc. The capillary pressure (or resistance) prevents the invading fluid from flowing from one A-box and into the next A-box. The DPD (slope 2303) will increase since the invading fluid is still flowing into the C-box until the capillary resistance is overcome and the C-regime suddenly collapses into the D-regime. This fluctuation between the D-regime and C-regime is manifested as pressure fluctuations, and the sudden collapse of the C-regime have been called localized bursts, avalanches or Haines jumps in the literature [4].

Figure 24:
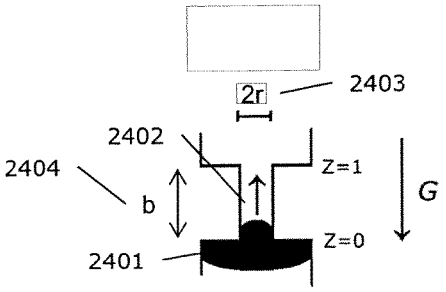
FIG. 24 is a sketch of an invading fluid passing from a pore through a pore throat.

The duration and dynamics of the Haines jumps is related to the Rayleigh time and capillary dynamics. FIG. 24 illustrates the case where an invading fluid 2401 (shown in black) invades a pore throat 2402 occupied by the defending fluid 2403 wetting the pore throat. The forces to be overcome are the viscous, capillary and gravity forces. Assuming that the pore throat 2402 has a circular cross sectional area 2403 of a radius r and a pore throat length b, 2404, one obtains the capillary dynamic equation $$\frac{d}{dt}(mu) = \pi a^2 \Delta p - F - \pi a^2 \frac{\gamma}{r} - \mathrm{mG}$$

when Newton's law of motion is applied. The viscous drag force $$F=8\pi\mu_z z\dot{z}+8\pi\mu_d(b-z)\dot{z}$$

and the inertia force $$\frac{d}{dt}(mu) = \pi r^2 \rho_d(\Delta\rho z\ddot{z} + b\ddot{z} + \Delta\rho\dot{z}^2),$$

can be expressed as shown, where $\mu_d$ and $\mu_i$ are the viscosity of the defending and invading fluid, respectively, and $\Delta p = (\rho_i - \rho_d)/\rho_d$ with $\rho_d$ and $\rho_i$ as symbols for the density of the defending and invading fluid.

The capillary dynamic equation describes the evolution of the position z of the capillary meniscus as it moves through the pore throat, and $\ddot{z}$ and $\dot{z}$ are the first and second time derivatives of the position Z. This equation cannot be solved analytically, but a numerical equation $$(\Delta\rho z+1)\ddot{z}+\Delta\rho\dot{z}^2=Cn-8Oh[Mz\dot{z}+(1-z)\dot{z}]-Boz-1$$

can be obtained by normalizing time with the Rayleigh time $\tau_R=\sqrt{\rho_d r^3/\gamma}$ and the position z with r and assuming that the length of the pore throat b can be estimated to be equal to the throat radius, b=r. The numerical capillary number $Cn=r\Delta p/\gamma$ is the relation between the pressure difference and the capillary pressure Pc. The dimensionless numbers Oh and Bo are the Ohnesorge, the Bond numbers, and $M=\mu_i/\mu_d$. The Ohnesorge number, [5] is given as $$Oh = \frac{\mu_d}{\sqrt{\gamma\rho_d r}}$$

and the Bond number, [6] is defined as $$Bo = \frac{(\rho_i - \rho_d)gr^2}{\gamma}$$

The equation can be solved numerically for some given dimensionless numbers with the initial conditions of z=0 and $\dot{z}=0$ at t=0. Notice, however, that with this initial condition Cn must be larger than one to get any movement of the meniscus. The numerical capillary number $Cn=r\Delta p/\gamma$ becomes $$\frac{r\Delta p}{\gamma} = \frac{r\mu\lambda U}{k\gamma} \sim \frac{r\mu r U}{k\gamma Ca} \sim 1$$

when assuming that $\Delta p$ is the Darcy pressure in the C-box with a length $\lambda=r/Ca$.

Figure 25:
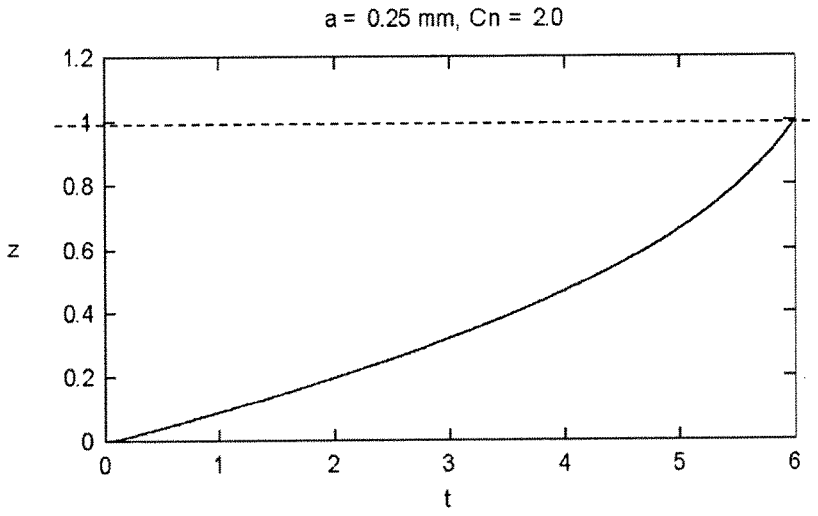
FIGS. 25-26 show the numerical simulations of the z position as a function of the for two different capillary numbers and for olive oil.
Figure 26:
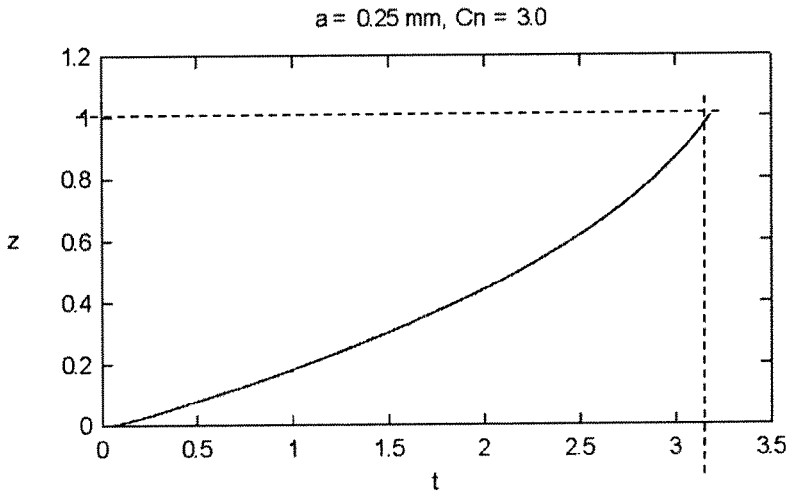

Numerical simulations are shown in the FIGS. 25 and 26 of the z position as a function of the time t normalised with the Rayleigh time and for two different capillary numbers of Cn=2 and Cn=3, respectively. These numerical simulations are performed with olive oil as defending fluid and water as invading fluid, which gives Oh=1.33, Bo=−0.005 and $\tau_R$=0.92 ms. The gravity force is not important for the motion through the pore throat and therefore disregarded here. From the numerical results can be seen that the time required for the meniscus (the z position) to move through the pore throat (i.e. reach z=1) is about 3 times (FIG. 25) and 6 times (FIG. 26) the Rayleigh times for Cn=2 and 3, respectively.

Figure 27:
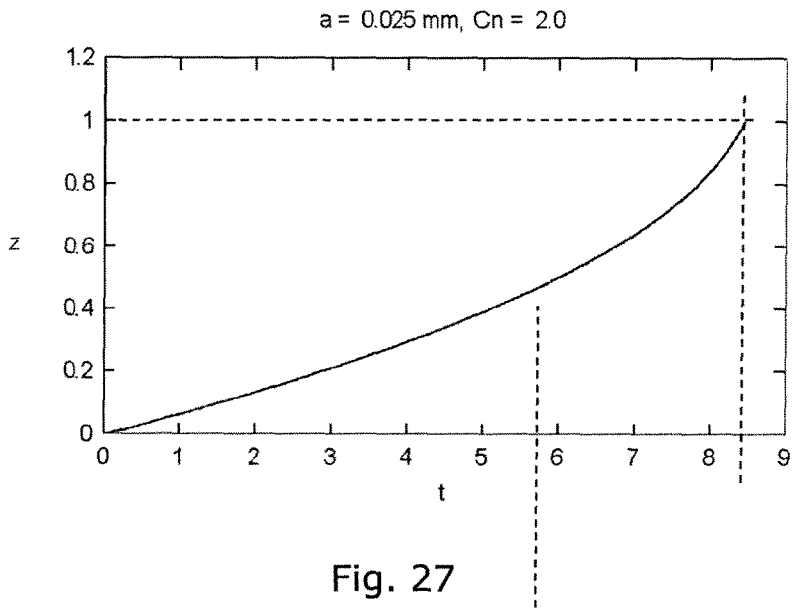
FIGS. 27-28 show the similar numerical simulations as in FIGS. 25-26 but for oil parameters of the Gullfaks oil field.
Figure 28:
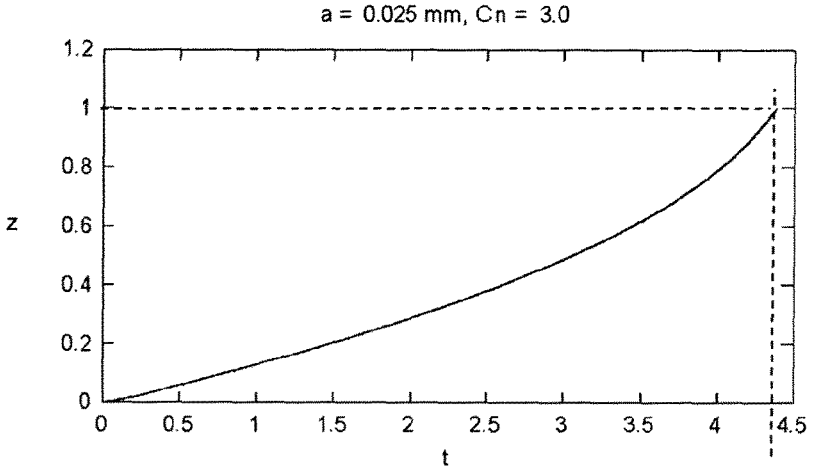

The same numerical simulations are performed in FIGS. 27 and 28 only based on the physical parameters of oil types observed at the Gullfaks oil field located in the Tampen area in the northern part of the North Sea (Norway). The calculations were based on an oil viscosity of 0.033 Pas, a surface tension of 0.013 N/m, and a pore throat radius estimated to be about 0.025 mm [7-8], yielding Oh=1.94 and $\tau_R$=0.04 ms. As can be seen from FIGS. 27 and 28, the numerical simulations indicate a duration of about 4-9 Rayleigh times.

These simulations support that the dynamics in the A-box occurs on the Rayleigh time scale. Therefore it would be advantageous to apply impact pressure stimulation during invasion percolation with a pressure rise time on the Rayleigh time order. In this case the pressure difference $\Delta p$ used in the numerical capillary number is $\Delta p$=Pi, where Pi is the pressure stimulation in the form of impact pressure. Applying that $\Delta p=Pi=2\gamma/r$ or $\Delta p=Pi=3\gamma/r$ gives Cn=2 or 3 as employed in the numerical simulations, indicating that a Darcy pressure is thus not needed to obtain a capillary fingering as observed in the results e.g. in FIG. 17. The consequence is that the C-box becomes as large as the W-box (as seen in FIG. 17) with the described impact pressure stimulation, yielding a recovery factor of 0.62 (or 62%) instead of 0.50.0.62=0.31 when the Darcy pressure is needed to obtain a capillary fingering. The recovery factor therefore increases dramatically with this kind of impact pressure stimulation as the factor 0.50 is eliminated. The obtained theoretical recovery factor of 62% is close to the experimentally observed recovery factor of 65%.

In the following are summarized embodiments according to the invention:

Embodiment 1 describes a method for recovery of a hydrocarbon fluid from a porous medium by injection of a fluid into the porous medium, comprising;

determining a Rayleigh time on the basis of the density of the fluid and the hydrocarbon fluid, the median pore diameter of the porous medium, and surface tension between the fluid and the hydrocarbon fluid;

providing a pressure stimulation in the fluid, wherein the pressure stimulation is generated by a collision process with a collision contact time which is of the range of 1-10 times the Rayleigh time, such as in the range of 1-3 times the Rayleigh time.

Embodiment 2 describes a method according to embodiment 1, wherein the collision contact time is determined on the basis of the mass, density, modulus of elasticity and Poisson's ratio of the colliding objects in the collision process, their relative velocities, and the bulk modulus of the fluid and the hydrocarbon fluid.

Embodiment 3 describes a method according to any of embodiments 1-2, further comprising determining a capillary pressure on the basis of the median pore diameter of the porous medium and the surface tension between the fluid and the hydrocarbon fluid, and wherein the pressure stimulation comprises generating an impact pressure with a pressure amplitude and rise time corresponding to a pressure difference over the median pore diameter of the porous medium which is of the order 1-5 times the capillary pressure.

Embodiment 4 describes a method according to any of embodiments 1-3, wherein the collision process comprises a collision between a falling object and a piston, where the object has a mass in the range of 10-2000 kg, such as in the range of 100-1500 kg, such as in the range of 500-1200 kg, and the object is caused to fall onto the piston from a height in the range of 0.02-2.0 m, such as in the range of 0.05-1.0 m, such as in the range of 0.1-0.5 m.

While preferred embodiments of the invention have been described, it should be understood that the invention is not so limited and modifications may be made without departing from the invention. The scope of the invention is defined by the appended claims, and all devices that come within the meaning of the claims, either literally or by equivalence, are intended to be embraced therein.

[1] Feder, J., Fractals, Plenum Press, New York (1988)

[2] Lenormand, R., Zarcone, C., Capillary fingering: percolation and fractal dimension, Transp. Porous Media 4, 599-612 (1989)

[3] Måløy, K. J., Feder, J., Jøssang, T., Viscous fingering fractals in porous media, Phys. Rev. Lett. 55, 2688-2691 (1985)

[4] Crandall, D., Ahmadi, G., Ferer, M., Smith, D., H., Distribution and occurrence of localized-bursts in two-phase flow through porous media, Physica A 388, 574-584 (2009)

[5] McKinley, G. H., Renardy M., Wolfgang von Ohnesorge, Phys. Fluids 23, 127101 (2011)

[6] Hager, W. H., Wilfrid Noel Bond and the Bond number, Journal Hyd. Res. 50, 3-9 (2012)

[7] "A Cataloge of crude oil and oil product properties" Environmental Protection Directorate, Ottawa, Canada, 1990

[8] "The effects of rock characteristics on relative permeability" National Institute for Petroleum and Energy Research, Bartlesville, Okla., USA, 1990

[9] Løvoll et al, Influence of viscous fingering on dynamic saturation-pressure curves in porous media, Transp. Porous Med. 86, 305-324 (2010)

The invention claimed is:

1. A method for recovery of a hydrocarbon fluid from a porous medium by injection of a fluid into the porous medium, comprising:

determining a median pore diameter of the porous medium based on a pore distribution of the porous medium;

determining a Rayleigh time on the basis of the density of the fluid and the hydrocarbon fluid, the median pore diameter of the porous medium, and surface tension between the fluid and the hydrocarbon fluid;

arranging an at least partly fluid-filled chamber in fluid communication with the porous medium via at least one conduit, wherein the chamber comprises a first and a second wall part movable relative to each other, arranging an object outside of the at least partly fluid-filled chamber; and providing a pressure stimulation on the fluid such as to achieve pressure propagating in the fluid and thereby into the porous medium, wherein the pressure stimulation is propagated by a collision process with a collision contact rise time which is of the range of 1-100 times the Rayleigh time, wherein the collision process comprises a collision between the object and the first wall part, the first wall part thereby impacting on the fluid inside the chamber, and wherein the porous formation forms part of a subterranean reservoir formation.

2. The method according to claim 1, wherein the pressure stimulation that is generated by the collision process has a pressure rise time which is of the range of 1-100 times the Rayleigh time.

3. A method for recovery of a hydrocarbon fluid from a porous medium by injection of a fluid into the porous medium, comprising:

determining a median pore diameter a of the porous medium based on a pore distribution of the porous medium by visual microscopic inspection, image analysis, flow porometry, gas adsorption, or mercury porosimetry;

arranging an at least partly fluid-filled chamber in fluid communication with the porous medium via at least one conduit, wherein the chamber comprises a first and a second wall part movable relative to each other, arranging an object outside of the at least partly fluid-filled chamber;

providing a pressure stimulation in the fluid, wherein the pressure stimulation is generated by a collision process generating an impact pressure with a pressure amplitude I and a pressure rise time $\Delta t$, where the pressure amplitude is larger than the relation $\gamma c\Delta t/a^2$, where $\gamma$ is the surface tension between the fluid and the hydrocarbon fluid, and c is the speed of sound in the porous medium, and wherein the collision process comprises a collision between the object and the first wall part, the first wall part thereby impacting on the fluid inside the chamber.

4. The method according to claim 1, wherein the pressure apparatus generates the pressure stimulation by generating an impact pressure with a pressure amplitude in the range of 1-5 times larger than $\gamma c\Delta t/a^2$, where $\gamma$ is the surface tension between the fluid and the hydrocarbon fluid, and c is the speed of sound in the porous medium.

5. The method according to claim 1, further comprising determining a capillary pressure on the basis of the median pore diameter of the porous medium and the surface tension between the fluid and the hydrocarbon fluid, and wherein an impact pressure of the pressure stimulation has a pressure amplitude and rise time corresponding to a pressure difference of the order of 1-5 times the capillary pressure over a length equal to the median pore diameter of the porous medium.

6. The method according to claim 1, further comprising determining a collision contact time of the collision process, and wherein the collision contact rise time is determined as a percentage of the collision contact time of the collision process in the range of 10-40%.

7. The method according to claim 1, where the median pore diameter of the porous medium is determined by means of mercury porosimetry on a sample of the porous medium.

8. The method according to claim 1, wherein the collision process comprises a collision between a falling object and a piston, where the object has a mass in the range of 10-10000 kg, and the object is caused to fall onto the piston from a distance in the range of 0.02-2.0 m.

9. The method according to claim 1, wherein the chamber comprises a zone wherein gas-inclusions naturally gather by influence of the gravitational forces, and the conduit is arranged in or adjacent to said zone and/or the chamber is arranged such that the first wall part impacting on the fluid is placed away from said zone.

10. The method according to claim 1, further comprising generating a number of said collision processes at time intervals.

11. The method according to claim 10, wherein said collision processes are generated at time intervals in the range of 1-20 seconds.

12. The method according to claim 10, comprising the step of generating a first sequence of collision processes with a first setting of pressure amplitude, pressure rise time, and time between the collisions, followed by a second sequence of collision processes with a different setting of pressure amplitude, pressure rise time, and time between the collisions.

13. The method according to claim 12, wherein said setting of pressure amplitude and rise time is changed by changing the mass of the object, and/or changing the velocity of the object relative to the first wall part prior to the collision.

14. A method for recovery of a hydrocarbon fluid from a porous medium by injection of a fluid into the porous medium, comprising:

determining a median pore diameter of the porous medium based on a pore distribution of the porous medium;

determining a Rayleigh time on the basis of the density of the fluid and the hydrocarbon fluid, the median pore diameter of the porous medium, and surface tension between the fluid and the hydrocarbon fluid;

arranging an at least partly fluid-filled chamber in fluid communication with the porous medium via at least one conduit, wherein the chamber comprises a first and a second wall part movable relative to each other, arranging an object outside of the at least partly fluid-filled chamber; and providing a pressure stimulation on the fluid, in order to achieve pressure propagating in the fluid and thereby into the porous medium, wherein the pressure stimulation is generated by a collision process with a collision contact rise time which is of the range of 1-100 times the Rayleigh time, and wherein the pressure stimulation is generated by the collision process generating an impact pressure with a pressure amplitude I and a pressure rise time $\Delta t$, where the pressure amplitude is larger than the relation $\gamma c \Delta t / a^2$, where $\gamma$ is the surface tension between the fluid and the hydrocarbon fluid, and c is the speed of sound in the porous medium, and wherein the collision process comprises a collision between the object and the first wall part, the first wall part thereby impacting on the fluid inside the chamber.

15. The method according to claim 10, wherein said collision processes are generated at time intervals in the range of 4-10 seconds.

16. The method according to claim 1, wherein the pressure apparatus generates the pressure stimulation by the collision process with the collision contact rise time which is of the range of 1-3 times the Rayleigh time.

17. The method according to claim 2, wherein the pressure apparatus generates the pressure stimulation by the collision process with the pressure rise time which is of the range of 1-3 times the Rayleigh time.

18. The method according to claim 14, wherein the pressure apparatus generates the pressure stimulation by the collision process with the collision contact rise time which is of the range of 1-3 times the Rayleigh time.

* * * * *